US009183839B2

(12) United States Patent
Faller

(10) Patent No.: US 9,183,839 B2
(45) Date of Patent: Nov. 10, 2015

(54) APPARATUS, METHOD AND COMPUTER PROGRAM FOR PROVIDING A SET OF SPATIAL CUES ON THE BASIS OF A MICROPHONE SIGNAL AND APPARATUS FOR PROVIDING A TWO-CHANNEL AUDIO SIGNAL AND A SET OF SPATIAL CUES

(75) Inventor: Christof Faller, St-Sulpice (CH)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 798 days.

(21) Appl. No.: 13/207,586

(22) Filed: Aug. 11, 2011

(65) Prior Publication Data

US 2011/0299702 A1 Dec. 8, 2011

Related U.S. Application Data

(63) Continuation of application No. 12/556,716, filed on Sep. 10, 2009, now Pat. No. 8,023,660, and a continuation of application No. PCT/EP2009/006457, filed on Sep. 4, 2009.

(60) Provisional application No. 61/095,962, filed on Sep. 11, 2008.

(51) Int. Cl.
*H04R 5/00* (2006.01)
*G10L 19/008* (2013.01)
(Continued)

(52) U.S. Cl.
CPC ..... *G10L 19/008* (2013.01); *H04S 5/005* (2013.01); *H04S 7/30* (2013.01); *H04R 5/027* (2013.01); *H04S 2420/03* (2013.01)

(58) Field of Classification Search
CPC ..... G10L 19/008; H04H 20/89; H04S 3/02
USPC ..... 381/1, 17–23, 61, 63, 98, 26, 119, 92, 381/116, 104; 700/94
See application file for complete search history.

(56) References Cited

U.S. PATENT DOCUMENTS 6,154,549 A * 11/2000 Arnold et al. ..... 381/104
6,904,152 B1 * 6/2005 Moorer ..... 381/18
(Continued)

FOREIGN PATENT DOCUMENTS

EP 1 761 110 A1 3/2007
JP 04-158000 A 5/1992
(Continued)

OTHER PUBLICATIONS

Pulkki et al., "Directional Audio Coding: Filterbank and STFT-Based Design," Audio Engineering Society Convent on Paper 6658, May 20, 2006, pp. 1-12.*
(Continued)

*Primary Examiner* — Lun-See Lao
(74) *Attorney, Agent, or Firm* — Keating & Bennett, LLP

(57) ABSTRACT

An apparatus for providing a set of spatial cues associated with an upmix audio signal having more than two channels on the basis of a two-channel microphone signal has a signal analyzer and a spatial side information generator. The signal analyzer is configured to obtain a component energy information and a direction information on the basis of the two-channel microphone signal, such that the component energy information describes estimates of energies of a direct sound component of the two-channel microphone signal and of a diffuse sound component of the two-channel microphone signal, and such that the directional information describes an estimate of a direction from which the direct sound component of the two-channel microphone signal originates. The spatial side information generator is configured to map the component energy information and the direction information onto a spatial cue information describing the set of spatial cues associated with an upmix audio signal having more than two channels.

13 Claims, 13 Drawing Sheets

(51) Int. Cl.

| | |
|---|---|
| ***H04S 5/00*** | (2006.01) |
| ***H04S 7/00*** | (2006.01) |
| *H04R 5/027* | (2006.01) |

(56) References Cited

U.S. PATENT DOCUMENTS

| | | | | |
|---|---|---|---|---|
| 7,006,636 | B2 | 2/2006 | Baumgarte et al. | |
| 7,606,373 | B2 * | 10/2009 | Moorer | 381/18 |
| 2003/0177006 | A1 | 9/2003 | Ichikawa et al. | |
| 2008/0004729 | A1 | 1/2008 | Hiipakka | |

FOREIGN PATENT DOCUMENTS

| | | | |
|---|---|---|---|
| JP | 2003-337594 | A | 11/2003 |
| JP | 2004-289762 | A | 10/2004 |
| JP | 2007-235334 | * | 9/2007 |
| JP | 2007-235334 | A | 9/2007 |
| RU | 2 367 033 | C2 | 8/2008 |
| WO | 02/063925 | A2 | 8/2002 |
| WO | 2005/101905 | A1 | 10/2005 |
| WO | 2006/108462 | A1 | 10/2006 |
| WO | 2006/132857 | A2 | 12/2006 |
| WO | 2007/110101 | A1 | 10/2007 |

OTHER PUBLICATIONS

Pulkki et al., "Directional Audio Coding: Filterbank and STFT-Based Design," Audio Engineering Society 120th Convention, Convention Paper 6658, May 20-23, 2006, pp. 1-12.

Faller; "Apparatus, Method and Computer Program for Providing a Set of Spatial Cues on the Basics of a Microphone Signal and Apparatus for Providing a Two-Channel Audio Signal and a Set of Spatial Cues"; U.S. Appl. No. 12/556,716, filed Sep. 10, 2009.

Official Communication issued in corresponding Japanese Patent Application No. 2011-526399, mailed on Mar. 5, 2013.

Official Communication issued in corresponding European Patent Application No. 09778354.2 mailed on May 15, 2015.

* cited by examiner

APPARATUS, METHOD AND COMPUTER PROGRAM FOR PROVIDING A SET OF SPATIAL CUES ON THE BASIS OF A MICROPHONE SIGNAL AND APPARATUS FOR PROVIDING A TWO-CHANNEL AUDIO SIGNAL AND A SET OF SPATIAL CUES

CROSS-REFERENCE TO RELATED APPLICATIONS

This application claims priority from U.S. patent application Ser. No. 12/556,716, which was filed on Sep. 10, 2009, from U.S. Provisional Patent Application No. 61/095,962, which was filed on Sep. 11, 2008, and from International Application (No. PCT/EP2009/006457), titled "APPARATUS, METHOD AND COMPUTER PROGRAM FOR PROVIDING A SET OF SPATIAL CUES ON THE BASIS OF A MICROPHONE SIGNAL AND APPARATUS FOR PROVIDING A TWO-CHANNEL AUDIO SIGNAL AND A SET OF SPATIAL CUES", which was filed with the European Patent Office on Sep. 4, 2009, and are incorporated herein in its entirety by reference.

BACKGROUND OF THE INVENTION

Embodiments according to the invention are related to an apparatus for providing a set of spatial cues associated with an upmix audio signal having more than two channels on the basis of a two-channel microphone signal. Further embodiments according to the invention are related to a corresponding method and to a corresponding computer program. Further embodiments according to the invention are related to an apparatus for providing a processed or unprocessed two-channel audio signal and a set of spatial cues.

Another embodiment according to the invention is related to a microphone front end for spatial audio coders.

In the following, an introduction will be given into the field of parametric representation of audio signals.

Parametric representation of stereo and surround audio signals has been developed over the last few decades and has reached a mature status. Intensity stereo (R. Waal and R. Veldhuis, "Subband coding of stereophonic digital audio signals," *Proc. IEEE ICASSP* 1991, pp. 3601-3604, 1991.), (J. Herre, K. Brandenburg, and D. Lederer, "Intensity stereo coding," 96*th AES Conv.*, February 1994, *Amsterdam* (*preprint* 3799), 1994.) is used in MP3 (ISO/IEC, *Coding of moving pictures and associated audio for digital storage media at up to about* 1.5 *Mbit/s—Part* 3: *Audio*. ISO/IEC 11172-3 International Standard, 1993, jTC1/SC29/WG11.), MPEG-2 AAC (—, *Generic coding of moving pictures and associated audio information—Part* 7: *Advanced Audio Coding*. ISO/IEC 13818-7 International Standard, 1997, jTC1/SC29/WG11.), and other audio coders. Intensity stereo is the original parametric stereo coding technique, representing stereo signals by means of a downmix and level difference information. Binaural Cue Coding (BCC) (C. Faller and F. Baumgarte, "Efficient representation of spatial audio using perceptual parametrization," in *Proc. IEEE Workshop on Appl. Of Sig. Proc. to Audio and Acoust.*, October 2001, pp. 199-202.), (—, "Binaural Cue Coding—Part II: Schemes and applications," *IEEE Trans. on Speech and Audio Proc.*, vol. 11, no. 6, pp. 520-531, November 2003.) has enabled significant improvement of audio quality by means of using a different filterbank for parametric stereo/surround coding than for audio coding (F. Baumgarte and C. Faller, "Why Binaural Cue Coding is better than Intensity Stereo Coding," in *Preprint* 112*th Conv. Aud. Eng. Soc.*, May 2002.), i.e. it can be viewed as a pre- and post-processor to a conventional audio coder. Further, it uses additional spatial cues for the parametrization than only level differences, i.e. also time differences and inter-channel coherence. Parametric Stereo (PS) (E. Schuijers, J. Breebaart, H. Purnhagen, and J. Engdegard, "Low complexity parametric stereo coding," in *Preprint* 117*th Conv. Aud. Eng. Soc.*, May 2004.), which is standardized in IEC/ISO MPEG, uses phase differences as opposed to time differences, which has the advantage that artifact free synthesis is easier achieved than for time delay synthesis. The described parametric stereo concepts were also applied to surround sound by BCC. The MP3 Surround (J. Herre, C. Faller, C. Ertel, J. Hilpert, A. Hoelzer, and C. Spenger, "MP3 Surround: Efficient and compatible coding of multi-channel audio," in *Preprint* 116*th Conv. Aud. Eng. Soc.*, May 2004.), (C. Faller, "Coding of spatial audio compatible with different playback formats," in *Preprint* 117*th Conv. Aud. Eng. Soc.*, October 2004.), and MPEG Surround (J. Herre, K. Kjörling, J. Breebaart, C. Faller, S. Disch, H. Purnhagen, J. Koppens, J. Hilpert, J. Rödén, W. Oomen, K. Linzmeier, and K. S. Chong, "Mpeg surround—the iso/mpeg standard for efficient and compatible multi-channel audio coding," in *Preprint* 122*th Conv. Aud. Eng. Soc.*, May 2007.) audio coders introduced spatial synthesis based on a stereo downmix, enabling stereo backwards compatibility and higher audio quality. A parametric multi-channel audio coder, such as BCC, MP3 Surround, and MPEG Surround, is often referred to as Spatial Audio Coder (SAC).

Recently a technique was proposed denoted spatial impulse response rendering (SIRR) (J. Merimaa and V. Pulkki, "Spatial impulse response rendering i: Analysis and synthesis," J. Aud. Eng. Soc., vol. 53, no. 12, 2005.), (V. Pulkki and J. Merimaa, "Spatial impulse response rendering ii: Reproduction of diffuse sound and listening tests," *J. Aud. Eng. Soc.*, vol. 54, no. 1, 2006.), which synthesizes impulse responses in any direction (relative to the microphone position) based on a single audio channel (W-signal of Bformat (M. A. Gerzon, "Periphony: Width-Height Sound Reproduction," *J. Aud. Eng. Soc.*, vol. 21, no. 1, pp. 2-10, 1973.), (K. Farrar, "Soundfield microphone," *Wireless World*, pp. 48-50, October 1979.) plus spatial information obtained from the B-format signals. This technique was later also applied to audio signals as opposed to impulse responses and called directional audio coding (DirAC) (V. Pulkki and C. Faller, "Directional audio coding: Filterbank and STFTbased design," in *Preprint* 120*th Conv. Aud. Eng. Soc.*, May 2006, p. preprint 6658.) DirAC can be viewed as a SAC, which is applicable directly to microphone signals. Various microphone configurations have been proposed for use with DirAC (J. Ahonen, G. D. Galdo, M. Kallinger, F. Kúch, V. Pulkki, and R. Schultz-Amling, "Analysis and adjustment of planar microphone arrays for application in directional audio coding," in *Preprint* 124$^{th}$ *Conv. Aud. Eng. Soc.,* May. 2008.), (J. Ahonen, M. Kallinger, F. Küch, V. Pulkki, and R. Schultz-Amling, "Directional analysis of sound field with linear microphone array and applications in sound reproduction," in *Preprint* 124*th Conv. Aud. Eng. Soc.*, May. 2008.). DirAC is based on Bformat signals and the signals of the various microphone configurations are processed to obtain B-format, which then is used in the directional analysis of DirAC.

In view of the above, it is the objective of the present invention to create a computationally efficient concept for obtaining a spatial cue information, while keeping the effort for the sound transduction reasonably small.

SUMMARY

According to an embodiment, an apparatus for providing a set of spatial cues associated with an upmix audio signal having more than two channels on the basis of a two-channel microphone signal may have a signal analyzer configured to acquire a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates; and a spatial side information generator configured to map the component energy information of the two-channel microphone signal and the direction information of the two-channel microphone signal onto a spatial cue information describing the set of spatial cues associated with an upmix audio signal having more than two channels.

According to another embodiment, an apparatus for providing a two-channel audio signal and a set of spatial cues associated with an upmix audio signal having more than two channels may have a microphone arrangement having a first directional microphone and a second directional microphone, wherein the first directional microphone and the second directional microphone are spaced by no more than 30 cm, and wherein the first directional microphone and the second directional microphone are oriented such that a directional characteristic of the second directional microphone is a rotated version of a directional characteristic of the first directional microphones; and an apparatus for providing a set of spatial cues associated with an upmix audio signal having more than two channels on the basis of a two-channel microphone signal which may have a signal analyzer configured to acquire a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates; and a spatial side information generator configured to map the component energy information of the two-channel microphone signal and the direction information of the two-channel microphone signal onto a spatial cue information describing the set of spatial cues associated with an upmix audio signal having more than two channels, wherein the apparatus for providing a set of spatial cues associated with an upmix audio signal is configured to receive the microphone signals of the first and second directional microphones as the two-channel microphone signal, and to provide the set of spatial cues on the basis thereof; and a two-channel audio signal provider configured to provide the microphone signals of the first and second directional microphones, or processed versions thereof, as the two-channel audio signal.

According to another embodiment, an apparatus for providing a processed two-channel audio signal and a set of spatial cues associated with an upmix signal having more than two channels on the basis of a two-channel microphone signal may have an apparatus for providing a set of spatial cues associated with an upmix audio signal having more than two channels on the basis of the two-channel microphone signals, wherein the apparatus may have a signal analyzer configured to acquire a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates; and a spatial side information generator configured to map the component energy information of the two-channel microphone signal and the direction information of the two-channel microphone signal onto a spatial cue information describing the set of spatial cues associated with an upmix audio signal having more than two channels; and a two-channel audio signal provider configured to provide processed two-channel audio signal on the basis of the two-channel microphone signal, wherein the two-channel audio signal provider is configured to scale a first audio signal of the two-channel microphone signal using one or more first microphone signal scaling factors, to acquire a first processed audio signal of the processed two-channel audio signal, wherein the two-channel audio signal provider is also configured to scale a second audio signal of the two-channel microphone signal using one or more second microphone signal scaling factors, to acquire a second processed audio signal of the processed two-channel audio signal, wherein the two-channel audio signal provider is configured to compute the one or more first microphone signal scaling factors and the one or more second microphone signal scaling factors on the basis of the component energy information provided by the signal analyzer of the apparatus for providing a set of spatial cues, such that both the spatial cues and the microphone signal scaling factors are determined by the component energy information.

According to another embodiment, a method for providing a set of spatial cues associated with an upmix audio signal having more than two channels on the basis of a two-channel microphone signal may have the steps of acquiring a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates; and mapping the component energy information of the two-channel microphone signal and the direction information of the two-channel microphone signal onto a spatial cue information describing spatial cues associated with an upmix audio signal having more than two channels.

According to another embodiment, a computer program may perform the method for providing a set of spatial cues associated with an upmix audio signal having more than two channels on the basis of a two-channel microphone signal, which may have the steps of acquiring a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates; and mapping the component energy information of the two-channel microphone signal and the direction information of the two-channel microphone signal onto a spatial cue information describing spatial cues associated with an upmix audio signal having more than two channels, when the computer program runs on a computer.

An embodiment according to the invention creates an apparatus for providing a set of spatial cues associated with an upmix audio signal having more than two channels on the basis of a two-channel microphone signal. The apparatus comprises a signal analyzer configured to obtain a component energy information and a direction information on the basis of the two-channel microphone signal such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates. The apparatus also comprises a spatial side information generator configured to map the component energy information of the two-channel microphone signal and the direction information of the two-channel microphone signal onto a spatial cue information describing a set of spatial cues associated with an upmix audio signal having more than two channels.

This embodiment is based on the finding that spatial cues of the upmix audio signal can be computed in a particularly efficient way if estimates of energies of a direct sound component and a diffuse sound component and the direction information are extracted from a two-channel signal and mapped onto the spatial cues, because the component energy information and the direction information can typically be extracted with moderate computational effort from an audio signal having only two channels but, nevertheless, constitute a very good basis for a computation of spatial cues associated with an upmix signal having more than two channels. In other words, even though the component energy information and the direction information are based on a two-channel signal, this information is well suited for a direct computation of the spatial cues without actually using the upmix audio channels as an intermediate quantity.

In an embodiment, the spatial side information generator is configured to map the direction information onto a set of gain factors describing a direction-dependent direct-sound to surround-audio-channel mapping. In addition, the spatial side information generator is configured to obtain channel intensity estimates describing estimated intensities of more than two surround channels on the basis of the component energy information and the gain factors. In this case, the spatial side information generator is configured to determine the spatial cues associated with the upmix audio signal on the basis of the channel intensity estimates. This embodiment is based on the finding that a two-channel microphone signal allows for an extraction of direction information, which can be mapped with good results onto a set of gain factors describing the direction-dependent direction-sound to surround-audio-channel mapping, such that it is possible to obtain meaningful channel intensity estimates describing the upmix audio signal and forming a basis for the computation of the spatial cue information.

In an embodiment, the spatial side information generator is also configured to obtain channel correlation information describing a correlation between different channels of the upmix signal on the basis of the component energy information and the gain factors. In this embodiment, the spatial side information generator is configured to determine spatial cues associated with the upmix signal on the basis of one or more channel intensity estimates and the channel correlation information. It has been found that the component energy information and the gain factors constitute an information, which is sufficient for the calculation of the channel correlation information, such that the channel correlation information can be computed without using any further variables (with the exception of some constants reflecting a distribution of the diffuse sound to the channels of the upmix signal). Further, it has been recognized that it is easily possible to determine spatial cues describing an inter-channel correlation of the upmix signal as soon as the channel intensity estimates and the channel correlation information is known.

In another embodiment, the spatial side information generator is configured to linearly combine an estimate of an intensity of a direct sound component of the two-channel microphone signal and an estimate of an intensity of a diffuse sound component of the two-channel microphone signal in order to obtain the channel intensity estimates. In this embodiment, the spatial side information generator is configured to weight the estimate of the intensity of the direct sound component in dependence on the gain factors and in dependence on the direction information. Optionally, the spatial side information generator may further be configured to weight the estimate of the intensity of the diffuse sound component in dependence on constant values reflecting a distribution of the diffuse sound component to the different channels of the upmix audio signal. It has been recognized that it is possible to derive the channel intensity estimates by a very simple mathematic operation, namely a linear combination, from the component energy information, wherein the gain factors, which can be derived efficiently from the two-channel microphone signal, constitute appropriate weighting factors.

Another embodiment according to the invention creates an apparatus for providing a two-channel audio signal and a set of spatial cues associated with an upmix audio signal having more than two channels. The apparatus comprises a microphone arrangement comprising a first directional microphone and a second directional microphone, wherein the first directional microphone and the second directional microphone are spaced by no more than 30 centimeters (or even by no more than 5 centimeters), and wherein the first directional microphone and the second directional microphone are oriented such that a directional characteristic of the second directional microphone is a rotated version of a directional characteristic of the first directional microphone. The apparatus for providing a two-channel audio signal also comprises an apparatus for providing a set of spatial cues associated with an upmix audio signal having more than two channels on the basis of a two-channel microphone signal, as discussed above. The apparatus for providing a set of spatial cues associated with an upmix audio signal is configured to receive the microphone signals of the first and second directional microphones as the two-channel microphone signal, and to provide the set of spatial cues on the basis thereof. The apparatus for providing the two-channel audio signal also comprises a two-channel audio signal provider configured to provide the microphone signals of the first and second directional microphones, or processed versions thereof, as the two-channel audio signal. According to the invention, this embodiment is based on the finding that microphones having a small distance can be used for providing appropriate spatial cue information if the directional characteristics of the microphones are rotated with respect to each other. Thus, it has been recognized that it is possible to compute meaningful spatial cues associated with an upmix audio signal having more than two channels on the basis of a physical arrangement, which is comparatively small. Notably, it has been found that the component energy information and the direction information, which allow for an efficient computation of the spatial cue information, can be extracted with low effort if the two microphones providing the two-channel microphone signal are arranged with a comparatively small spacing (e.g. not exceeding 30 centimeters)

and consequently comprise very similar diffuse sound information. Further, it has been found that the usage of directional microphones having directional characteristics rotated with respect to each other allows for a computation of the component energy information and the direction information, because the different directional characteristics allow for a separation between directional sound and diffuse sound.

Another embodiment according to the invention creates an apparatus for providing a processed two-channel audio signal and a set of spatial cues associated with an upmix signal having more than two channels on the basis of a two-channel microphone signal. The apparatus for providing the processed two-channel audio signal comprises an apparatus for providing a set of spatial cues associated with an upmix audio signal having more than two channels on the basis of the two-channel microphone signal, as discussed above. The apparatus for providing the processed two-channel signal and the set of spatial cues also comprises a two-channel audio signal provider configured to provide the processed two-channel audio signal on the basis of the two-channel microphone signal. The two-channel audio signal provider is configured to scale a first audio signal of the two-channel microphone signal using one or more first microphone signal scaling factors to obtain a first processed audio signal of the processed two-channel audio signal. The two-channel audio signal provider is also configured to scale a second audio signal of the two-channel microphone signal using one or more second microphone signal scaling factors to obtain a second processed audio signal of the processed two-channel audio signal. The two-channel audio signal provider is configured to compute the one or more first microphone signal scaling factors and the one or more second microphone signal scaling factors on the basis of the component energy information provided by the signal analyzer of the apparatus for providing a set of spatial cues, such that both the spatial cues and the microphone signal scaling factors are determined by the component energy information. This embodiment is based on the idea that it is efficient to use the component energy information provided by the signal analyzer both for a calculation of the set of spatial cues and for an appropriate scaling of the microphone signals, wherein the appropriate scaling of the microphone signals may result in an adaptation of the microphone signals and the spatial cues, such that the combined information comprising both the processed microphone signals and the spatial cues conforms with a desired spatial audio coding industry standard (e.g. MPEG surround), thereby providing the possibility to play back the audio content on a conventional spatial audio coding decoder (e.g. a conventional MPEG surround decoder).

Another embodiment of the invention creates a method for providing a set of spatial cues associated with an upmix audio signal having more than two channels on the basis of a two-channel microphone signal.

Yet another embodiment according to the invention creates a computer program for performing the method.

Other features, elements, steps, characteristics and advantages of the present invention will become more apparent from the following detailed description of preferred embodiments of the present invention with reference to the attached drawings.

BRIEF DESCRIPTION OF THE DRAWINGS

Embodiments according to the invention will subsequently be described taking reference to the enclosed Figs., in which.

DETAILED DESCRIPTION OF THE INVENTION

Figure 1:
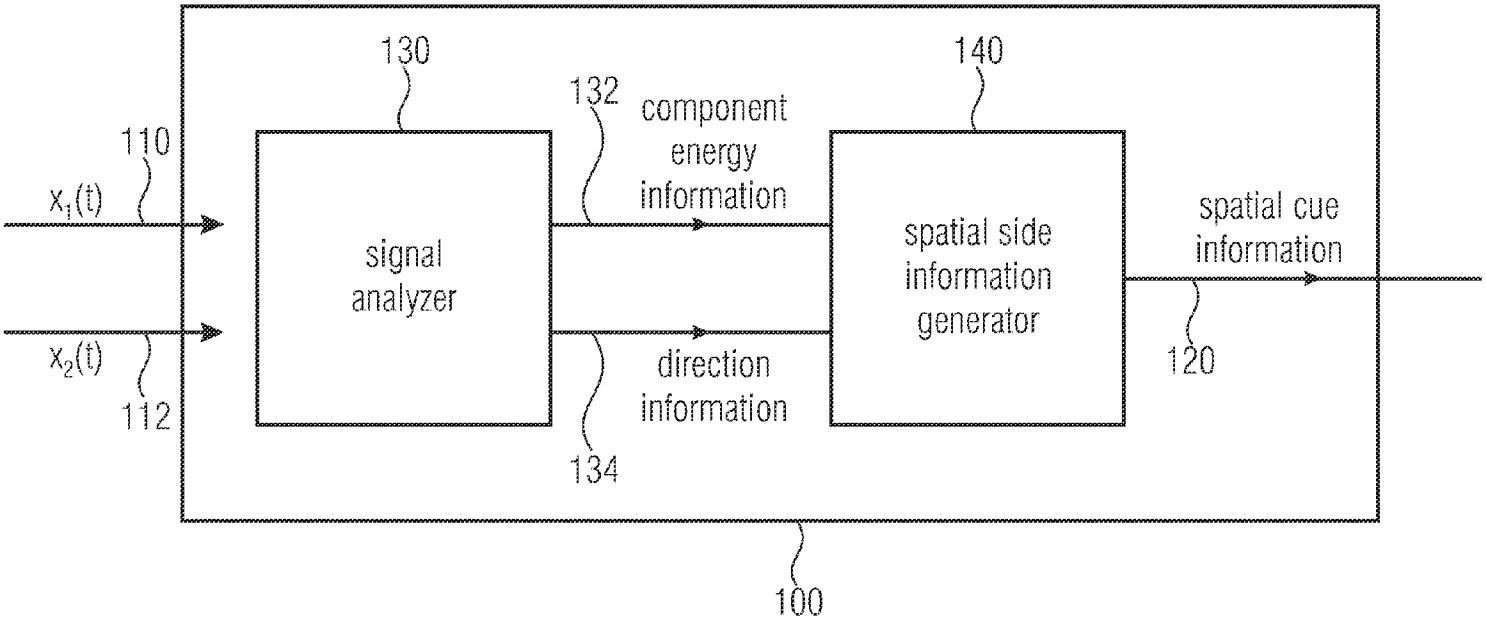
FIG. 1 shows a block schematic diagram of an apparatus for providing a set of spatial cues associated with an upmix audio signal having more than two channels on the basis of a two-channel microphone signal, according to an embodiment of the invention.

FIG. 1 shows a block schematic diagram of an apparatus 100 for providing a set of spatial cues associated with an upmix audio signal having more than two channels on the basis of a two-channel microphone signal. The apparatus 100 is configured to receive a two-channel microphone signal, which may, for example, comprise a first channel signal 110 (also designated with $x_1$) and a second channel signal 112 (also designated with $x_2$). The apparatus 100 is further configured to provide a spatial cue information 120.

The apparatus 100 comprises a signal analyzer 130, which is configured to receive the first channel signal 110 and the second channel signal 112. The signal analyzer 130 is configured to obtain a component energy information 132 and a direction information 134 on the basis of the two-channel microphone signals, i.e. on the basis of the first channel signal 110 and the second channel signal 112. The signal analyzer 130 is configured to obtain the component energy information 132 and the direction information 134 such that the component energy information 132 describes estimates of energies of a direct sound component of the two-channel microphone signal and of a diffuse sound component of the two-channel microphone signal, and such that the direction information 134 describes an estimate of a direction from which the direct sound component of the two-channel microphone signal 110, 112 originates.

The apparatus 100 also comprises a spatial side information generator 140, which is configured to receive the component energy information 132 and the direction information 134, and to provide, on the basis thereof, the spatial cue information 120. Advantageously, the spatial side information generator 140 is configured to map the component energy information 132 of the two-channel microphone signal 110, 112 and the direction information 134 of the two-channel microphone signal 110, 112 onto the spatial cue information 120. Accordingly, the spatial side information 120 is obtained such that the spatial cue information 120 describes a set of spatial cues associated with an upmix audio signal having more than two channels.

Thus, the apparatus 120 allows for a computationally very efficient computation of the spatial cue information, which is associated with an upmix audio signal having more than two channels on the basis of a two-channel microphone signal. The signal analyzer 130 is capable of extracting a large amount of information from the two-channel microphone signal, namely a component energy information describing both an estimate of an energy of a direct sound component and an estimate of an energy of a diffuse sound component and a direction information describing an estimate of a direction from which the direct sound component of the two-channel microphone signal originates. It has been found that this information, which can be obtained by the signal analyzer on the basis of the two-channel microphone signal 110, 112, is sufficient to derive the spatial cue information even for an upmix audio signal having more than two channels. Importantly, it has been found that the component energy 132 and the direction information 134 are sufficient to directly determine the spatial cue information 120 without actually using the upmix audio channels as an intermediate quantity.

In the following, some extensions of the apparatus 100 will be described taking reference to FIGS. 2 and 3.

Figure 2:
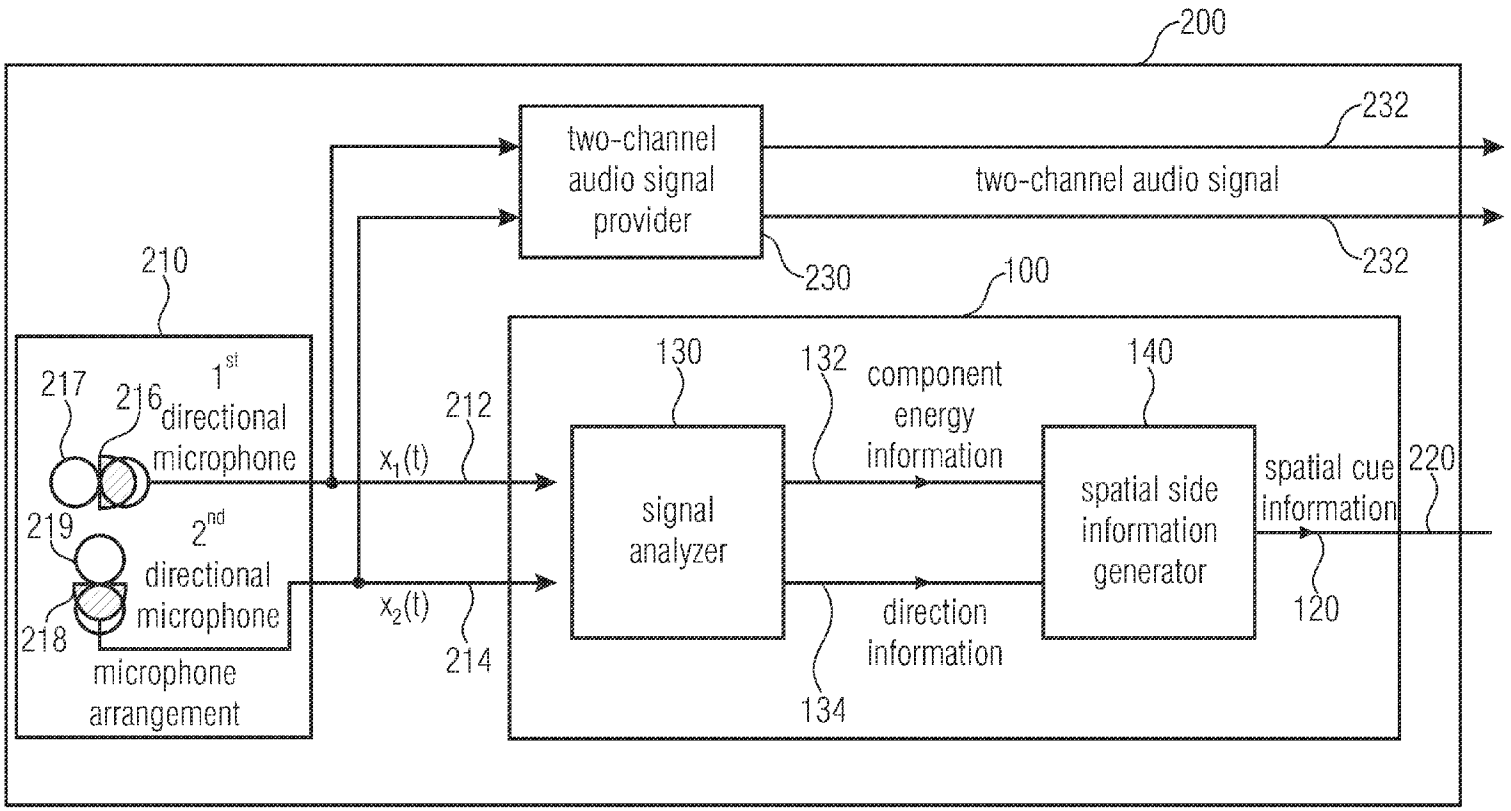
FIG. 2 shows a block schematic diagram of an apparatus for providing a set of spatial cues associated with an upmix audio signal having more than two channels, according to another embodiment of the invention.

FIG. 2 shows a block schematic diagram of an apparatus 200 for providing a two-channel audio signal and a set of spatial cues associated with an upmix audio signal having more than two channels. The apparatus 200 comprises a microphone arrangement 210 configured to provide a two-channel microphone signal comprising a first channel signal 212 and a second channel signal 214. The apparatus 200 further comprises an apparatus 100 for providing a set of spatial cues associated with an upmix audio signal having more than two channels on the basis of a two-channel microphone signal, as described with reference to FIG. 1. The apparatus 100 is configured to receive, as its input signals, the first channel signal 212 and the second channel signal 214 provided by the microphone arrangement 210. The apparatus 100 is further configured to provide a spatial cue information 220, which may be identical to the spatial cue information 120. The apparatus 200 further comprises a two-channel audio signal provider 230, which is configured to receive the first channel signal 212 and the second channel signal 214 provided by the microphone arrangement 210, and to provide the first channel microphone signal 212 and the second channel microphone signal 214, or processed versions thereof, as a two channel audio signal 232.

The microphone arrangement 210 comprises a first directional microphone 216 and a second directional microphone 218. The first directional microphone 216 and the second directional microphone 218 are spaced by no more than 30 centimeters. Accordingly, the signals received by the first directional microphone 216 and the second directional microphone 218 are strongly correlated, which has been found to be beneficial for the calculation of the component energy information and the direction information by the signal analyzer 130. However, the first directional microphone 216 and the second directional microphone 218 are oriented such that a directional characteristic 219 of the second directional microphone 218 is a rotated version of a directional characteristic 217 of the first directional microphone 216. Accordingly, the first channel microphone signal 212 and the second channel microphone signal 214 are strongly correlated (due to the spatial proximity of the microphones 216, 218) yet different (due to the different directional characteristics 217, 219 of the directional microphones 216, 218). In particular, a directional signal incident on the microphone arrangement 210 from an approximately constant direction causes strongly correlated signal components of the first channel microphone signal 212 and the second channel microphone signal 214 having a temporally constant direction-dependent amplitude ratio (or intensity ratio). An ambient audio signal incident on the microphone array 210 from temporally-varying directions causes signal components of the first channel microphone signal 212 and the second channel microphone signal 214 having a significant correlation, but temporarily fluctuating amplitude ratios (or intensity ratios). Accordingly, the microphone arrangement 210 provides a two-channel microphone signal 212, 214, which allows the signal analyzer 130 of the apparatus 100 to distinguish between direct sound and diffuse sound even though the microphones 216, 218 are closely spaced. Thus, the apparatus 200 constitutes an audio signal provider, which can be implemented in a spatially compact form, and which is, nevertheless, capable of providing spatial cues associated with an upmix signal having more than two channels. The spatial cues 220 can be used in combination with the provided two-channel audio signal 232 by a spatial audio decoder to provide a surround sound output signal.

Figure 3:
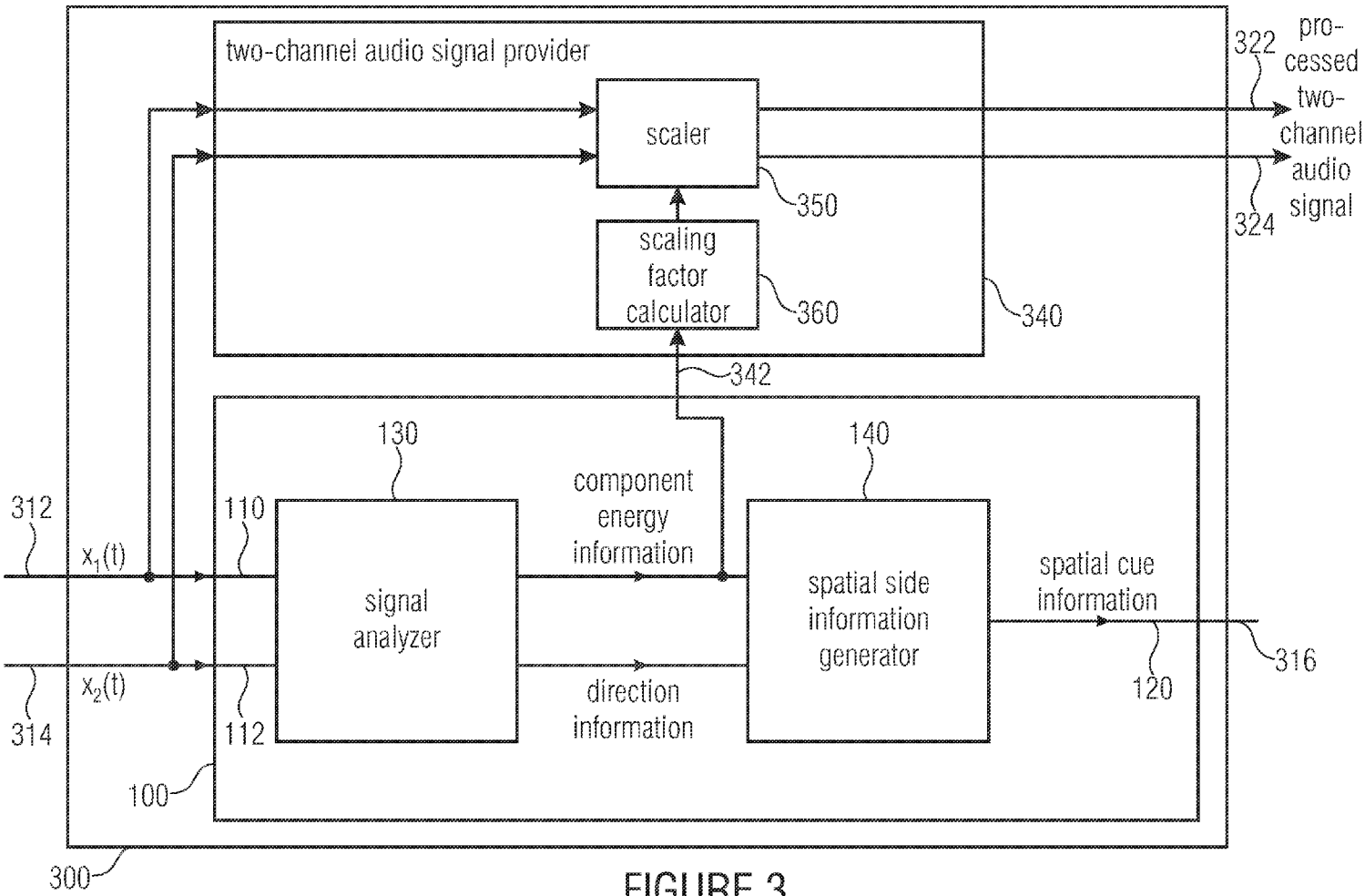
FIG. 3 shows a block schematic diagram of an apparatus for providing a set of spatial cues associated with an upmix audio signal having more than two channels, according to another embodiment of the invention.

FIG. 3 shows a block schematic diagram of an apparatus 300 for providing a processed two-channel audio signal and a set of spatial cues associated with an upmix signal having more than two channels on the basis of a two-channel microphone signal. The apparatus 300 is configured to receive a two-channel microphone signal comprising a first channel signal 312 and a second channel signal 314. The apparatus 300 is configured to provide a spatial cue information 316 on the basis of the two-channel microphone signal 312, 314. In addition, the apparatus 300 is configured to provide a processed version of the two-channel microphone signal wherein the processed version of the two-channel microphone signal comprises a firsts channel signal 322 and a second channel signal 324.

The apparatus 300 comprises an apparatus 100 for providing a set of spatial cues associated with an upmix audio signal having more than two channels on the basis of the two-channel signal 312, 314. In the apparatus 300, the apparatus 100 is configured to receive, as its input signals 110, 112, the first channel signal 312 and the second channel signal 314. Further, the spatial cue information 120 provided by the apparatus 100 constitutes the output information 316 of the apparatus 300.

In addition, the apparatus 300 comprises a two-channel audio signal provider 340, which is configured to receive the first channel signal 312 and the second channel signal 314. The two-channel audio signal provider 340 is further configured to also receive a component energy information 342, which is provided by the signal analyzer 130 of the apparatus 100. The two-channel audio signal provider 340 is further configured to provide the first channel signal 322 and the second channel signal 324 of the processed two-channel audio signal.

The two-channel audio signal provider comprises a scaler 350, which is configured to receive the first channel signal 312 of the two-channel microphone signal, and to scale the first channel signal 312, or individual time/frequency bins thereof, to obtain the first channel signal 322 of the processed two-channel audio signal. The scaler 350 is also configured to receive the second channel signal 314 of the two-channel microphone signal and to scale the second channel signal 314, or individual time/frequency bins thereof, to obtain the second channel signal 324 of the processed two-channel audio signal.

The two-channel audio signal provider 340 also comprises a scaling factor calculator 360, which is configured to compute scaling factors to be used by the scaler 350 on the basis of the component energy information 342. Accordingly, the component energy information 342, which describes estimates of energies of a direct sound component of the two-channel microphone signal and also of a diffuse sound component of the two-channel microphone signal, determines the scaling of the first channel signal 312 and the second channel signal 314 of the two-channel microphone signal, which scaling is applied to derive the first channel signal 322 and the second channel signal 324 of the processed two-channel audio signal from the two-channel microphone signal. Accordingly, the same component energy information is used to determine the scaling of the first channel signal 312 and of the second channel signal 314 of the two-channel microphone signal and also the spatial cue information 120. It has been found that the double-usage of the component energy information 342 is a computationally very efficient solution and also ensures a good consistency between the processed two-channel audio signal and the spatial cue information. Accordingly, it is possible to generate the processed two-channel audio signal and the spatial cue information such that they allow for a surround playback of an audio content represented by the two-channel microphone signals 312, 314 using a standardized surround decoder.

Implementation Details—Stereo Microphones and their Suitability for Surround Recording In this section, various two-channel microphone configurations are discussed with respect to their suitability for generating a surround sound signal by means of post-processing. The next section applies these insights to the use of spatial audio coding (SAC) with stereo microphones.

The microphone configurations described here may, for example, be used to obtain the two-channel microphone signal 110, 112 or the two-channel microphone signal 212, 214 or the two-channel microphone signal 312, 314. The microphone configurations described here may be used in the microphone arrangement 210.

Since human source localization largely depends on direct sound, due to the "law of the first wavefront" (J. Blauert, Spatial Hearing: The Psychophysics of Human Sound Localization, revised ed. Cambridge, Mass., USA: The MIT Press, 1997), the analysis in this section is carried out for a single direct far-field sound arriving from a specific angle $\alpha$ at the microphone in free-field (no reflections). Without loss of generality, for simplicity, we are assuming that the microphones are coincident, i.e. the two microphone capsules (e.g. the directional microphones 216, 218) are located in the same point. Given these assumptions, the left and right microphone signals can be written as:

$$x_1(n)=r_1(\alpha)s(n)$$

$$x_2(n)=r_2(\alpha)s(n), \tag{1}$$

where n is the discrete time index, s(n) corresponds to the sound pressure at the microphone location, $r_1(\alpha)$ is the directional response of the left microphone for sound arriving from angle $\alpha$, and $r_2(\alpha)$ is the corresponding response of the right microphone. The signal amplitude ratio between the right and left microphone is $$a(\alpha) = \frac{r_2(\alpha)}{r_1(\alpha)}. \tag{2}$$

Note that the amplitude ratio captures the level difference and information whether the signals are in phase ($a(\alpha)>0$) or out of phase ($a(\alpha)<0$). If a complex signal representation (e.g. of the microphone signals $x_1(n)$, $x_2(n)$) is used, such as a short-time Fourier transform, the phase of $a(\alpha)$ gives information about the phase difference between the signals and information about the delay. This information is useful when the microphones are not coincident.

Figure 4:
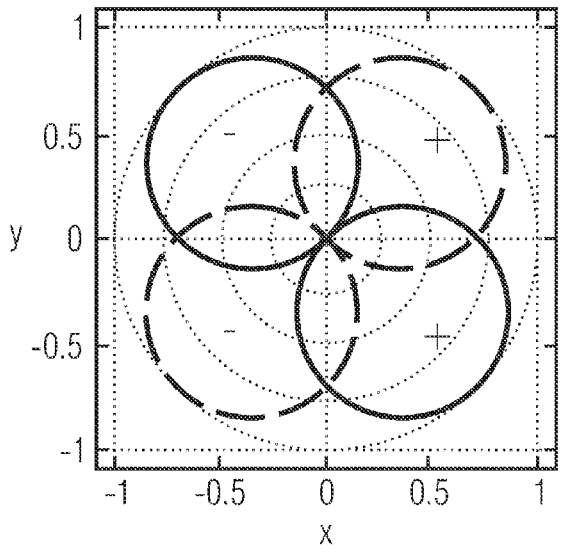
FIG. 4 shows a graphical representation of the directional responses of two dipole microphones, which can be used in embodiments of the invention.
Figure 5A:
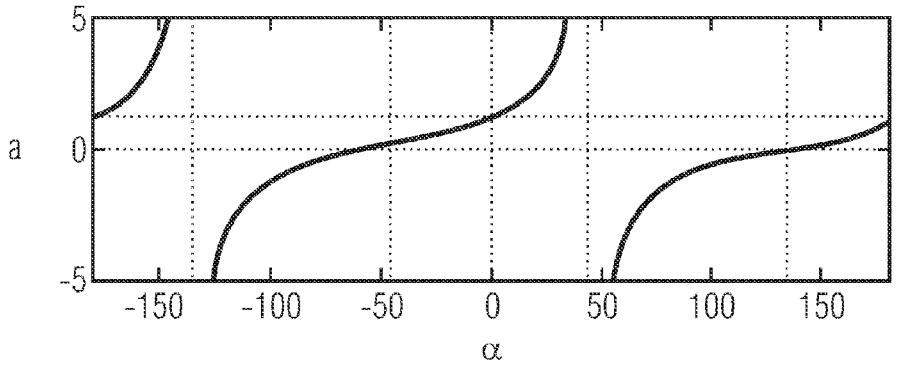
FIG. 5*a* shows a graphical representation of an amplitude ratio between left and right as a function of direction of arrival of sound for the dipole stereo microphone.
Figure 5B:
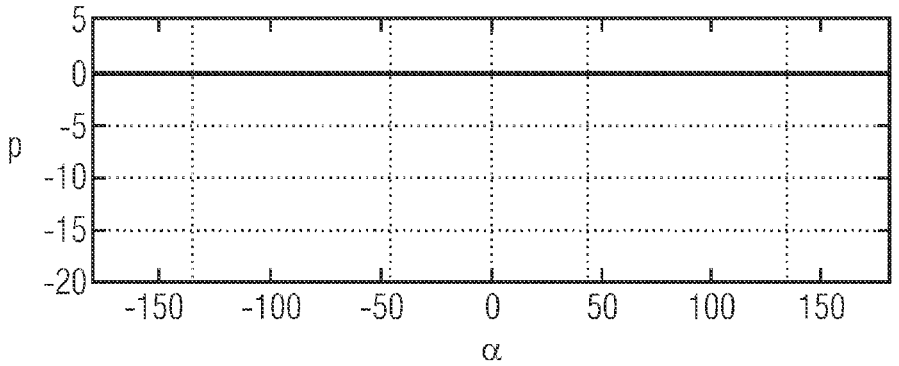
FIG. 5*b* shows a graphical representation of a total power as a function of direction of arrival of the sound for the dipole stereo microphone.

FIG. 4 illustrates the directional responses of two coincident dipole (figure of eight) microphones pointing towards ±45 degrees relative to the forward x-axis. The parts of the responses marked with a + capture sound with a positive sign and the parts marked with a − capture sound with a negative sign. The amplitude ratio as a function of direction of arrival of sound is shown in FIG. 5(*a*). Note that the amplitude ratio $a(\alpha)$ is not an invertible function, that is for each amplitude ratio value exist two directions of arrival which could have resulted in that amplitude ratio. If sound arrives only from front directions, i.e. within ±90 degrees relative to the positive x direction in FIG. 4, the amplitude ratio uniquely indicates from where sound arrived. However, for each direction in the front there exists a direction in the rear resulting in the same amplitude ratio captures the level difference and amplitude ratio. FIG. 5(*b*) shows the total response of the two dipoles in dB, i.e.

$$p(\alpha)=10\log_{10}(r_1^2(\alpha)+r_2^2(\alpha)). \quad (3)$$

Note that the two dipole microphones capture sound with the same total response from all directions (0 dB).

From the above discussion it can be concluded that two dipole microphones with responses as shown in FIG. 4 are not well suited for surround sound signal generation because of these reasons:

- Only for an angular range of 180 degrees does the amplitude ratio uniquely determine the direction of sound arrival.
- Rear and front sound is captured with the same total response. There is no rejection of sound from directions outside of the range in which the amplitude ratio is unique.

Figure 6:
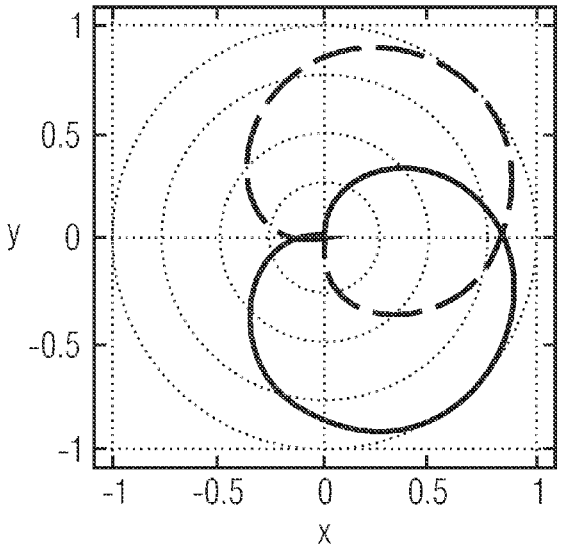
FIG. 6 shows a graphical representation of directional responses of two cardioid microphones, which can be used in some embodiments of the invention.
Figure 7A:
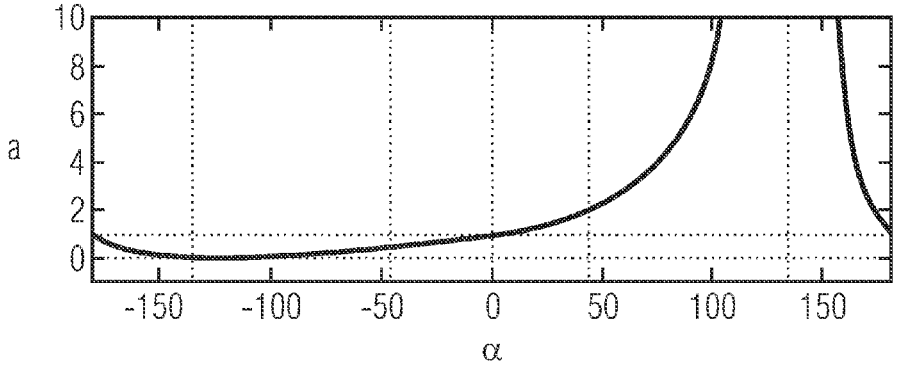
FIG. 7*a* shows a graphical representation of an amplitude ratio between left and right as a function of direction of arrival of sound for the cardioid stereo microphone.
Figure 7B:
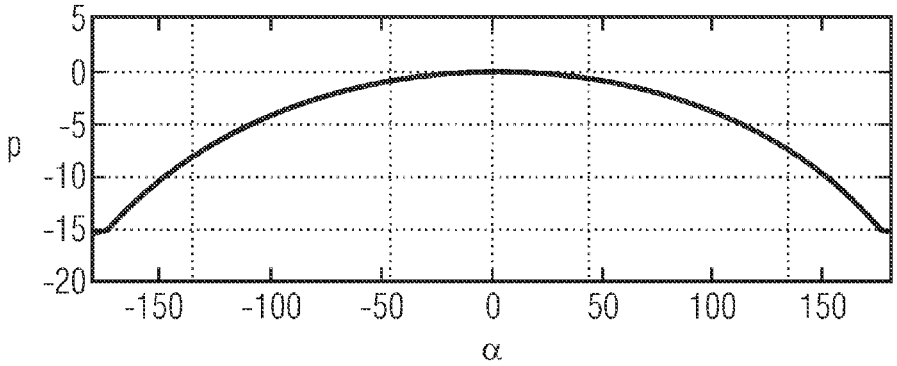
FIG. 7*b* shows a graphical representation of a total power as a function of direction of arrival of sound for the cardioid stereo microphone.

The next microphone configuration considered consists of two cardioids pointing towards ±45 degrees with responses as shown in FIG. 6. The result of a similar analysis as previously is shown in FIG. 7. FIG. 7(*a*) shows a(α) as a function of direction of arrival of sound. Note that for directions between −135 and 135 degrees a(α) uniquely determines the direction of arrival of the sound at the microphones. FIG. 7(*b*) shows the total response as a function of direction of arrival. Note that sound from the front directions is captured more strongly and sound is captured more weakly the more it arrives from the rear.

From this discussion it can be concluded that two cardioid microphones with responses as shown in FIG. 6 are suitable for surround sound generation for the following reasons:

- Three quarters of all possible directions of arrival (270 degrees) can uniquely be determined by means of measuring the amplitude ratio a(α), that is, sound arriving from directions between ±135 degrees.
- Sound arriving from directions which can not uniquely be determined, i.e. from the rear between 135 and 225 degrees, is attenuated, partially mitigating the negative effect of interpreting these sounds as coming from front directions.

Figure 8:
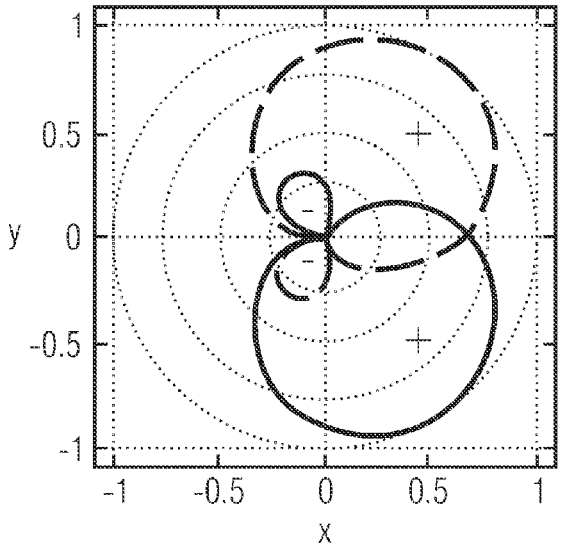
FIG. 8 shows a graphical representation of directional responses of two super-cardioid microphones, which can be used in some embodiments of the invention.
Figure 9A:
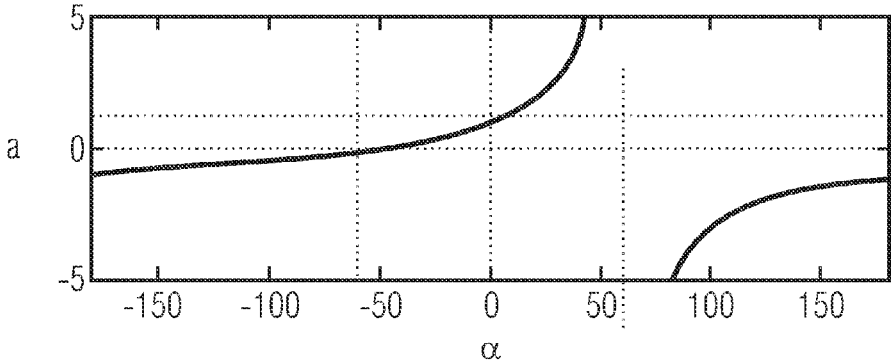
FIG. 9*a* shows a graphical representation of an amplitude ratio between left and right as a function of direction of arrival of sound for the super-cardioid stereo microphone.
Figure 9B:
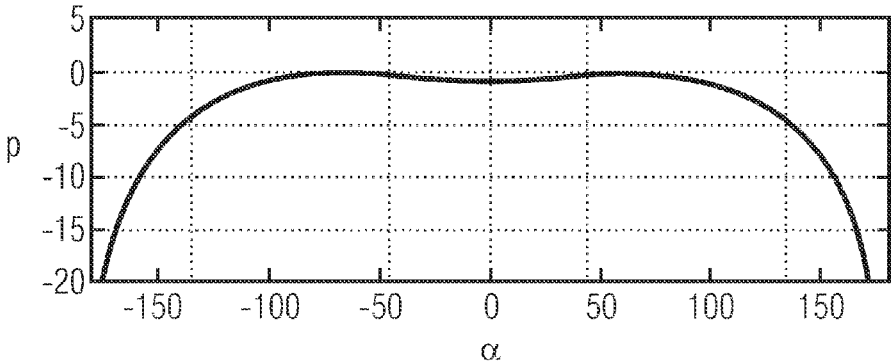
FIG. 9*b* shows a graphical representation of total power as a function of direction of arrival of sound for the super-cardioid stereo microphone.

A particularly suitable microphone configuration involves the use of super-cardioid microphones or other microphones with a negative rear lobe. The responses of two super-cardioid microphones, pointing towards about ±60 degrees, are shown in FIG. 8. The amplitude ratio as a function of angle of arrival is shown in FIG. 9(*a*). Note that the amplitude ratio uniquely determines the direction of sound arrival. This is so, because we have chosen the microphone directions such that both microphones have a null response at 180 degrees. The other null responses are at about ±60 degrees.

Note that this microphone configuration picks up sound in phase (a(α)>0) for front directions in the range of about ±60 degrees. Rear sound is captured but of phase (a(α)<0), i.e. with a different sign. Matrix surround encoding (J. M. Eargle, "Multichannel stereo matrix systems: An overview," *IEEE Trans. on Speech and Audio Proc.*, vol. 19, no. 7, pp. 552-559, July 1971.), (K. Gundry, "A new active matrix decoder for surround sound," in *Proc. AES* 19*th Int. Conf.*, June 2001.) gives similar amplitude ratio cues (C. Faller, "Matrix surround revisited," in *Proc.* 30*th Int. Conv. Aud. Eng. Soc.*, March 2007.) in the matrix encoded two-channel signals. From this perspective, this microphone configuration is suitable for generating a surround sound signal by means of processing the captured signals.

FIG. 9(*b*) illustrates the total response of the microphone configuration as a function of direction of arrival. In a large range of directions, sound is captured with similar intensity. Towards the rear the total response is decaying until it reaches zero (minus infinity dB) at 180 degrees.

The function $$\hat{\alpha}=f(\alpha) \quad (4)$$

yields the direction of arrival of sound as a function of the amplitude ratio between the microphone signals. The function in (4) is obtained by inverting the function given in (2) within the desired range in which (2) is invertible.

For the example of two cardioids as shown in FIG. 6, the direction of arrival will be in the range of ±135 degrees. If sound arrives from outside this range, its amplitude ratio will be interpreted wrongly and a direction in the range between ±135 degrees will be returned by the function. For the example of two super-cardioid microphones as shown in FIG. 8, the determined direction of arrival can be any value except 180 degrees since both microphones have their null at 180 degrees.

As a function of direction of arrival, the gain of the microphone signals may need to be modified in order to capture sound with the same intensity within a desired range of directions. The modification of the gain of the microphone signals may be performed prior to a processing of the microphone signals in the apparatus 100, for example, within the microphone arrangement 210. The gain modification as a function of direction of arrival is $$g(\hat{\alpha})=\min\{-p(\hat{\alpha}),G\}, \quad (5)$$

where G determines an upper limit in dB for the gain modification. Such an upper limit is often a prerequisite to prevent that the signals are scaled by too large a factor.

Figure 10A:
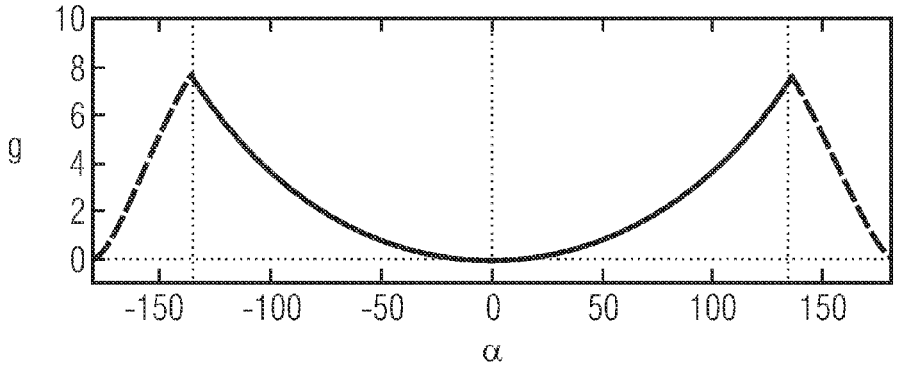
FIG. 10*a* shows a graphical representation of a gain modification as a function of direction of arrival of sound for the cardioid stereo microphone.
Figure 10B:
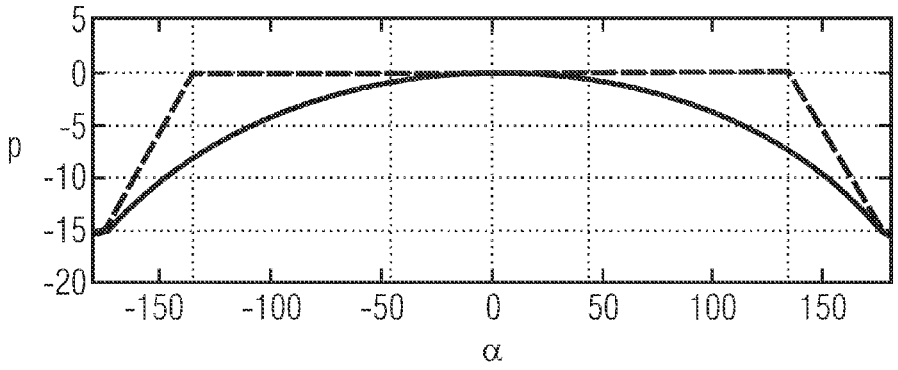
FIG. 10*b* shows a graphical representation of a total power (solid: Without gain modification, dashed: With gain modification) as a function of direction of arrival of sound for the cardioid stereo microphone.

The solid line in FIG. 10(*a*) shows the gain modification within the desired direction of arrival range of ±135 for the case of the two cardioids. The dashed line in FIG. 10(*a*) indicates the gain modification that is applied to sound from rear directions, i.e. between 135 and 225 degrees, where (4) yields a (wrong) front direction. For example for a direction of arrival of α=180 degrees, the estimated direction of arrival (4) is $\hat{\alpha}$=0 degrees. Therefore the gain modification is the same as for α=0 degrees, i.e. 0 dB. FIG. 10(*b*) shows the total response of the two cardioids (solid) and the total response if the gain modification is applied (dashed). The limit G in (4) was chosen to be 10 dB, but is not reached as indicated by the data in FIG. 7(*a*).

Figure 11A:
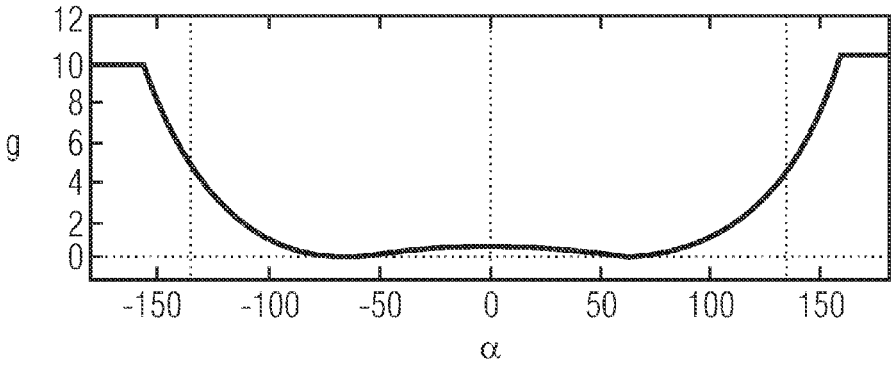
FIG. 11*a* shows a graphical representation of a gain modification as a function of direction of arrival of sound for the super-cardioid stereo microphone.
Figure 11B:
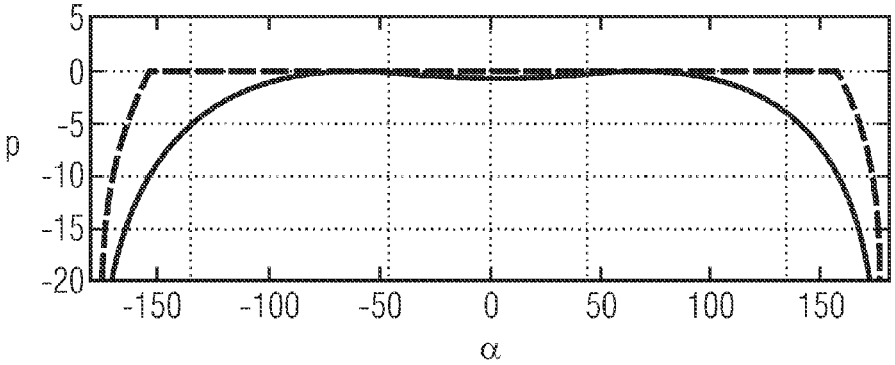
FIG. 11*b* shows a graphical representation of a total power (solid: Without gain modification, dashed: With gain modification) as a function of direction of arrival of sound for the super-cardioid stereo microphone.

A similar analysis is carried out for the case of the super-cardioid microphone pair. FIG. 11(*a*) shows the gain modification for this case. Note that near 180 degrees the limit of G=10 dB is reached. FIG. 11(*b*) shows the total response (solid) and the total response if the gain modification is applied (dashed). Due to the limitation of the gain modification, the total response is decreasing towards the rear (due to the nulls at 180 degrees, infinite modification would be needed). After gain modification, sound is captured with full level (0 dB) approximately in a range of 160 degrees, making this stereo microphone configuration in principle very suitable for capturing signals to be converted to surround sound signals.

The previous analysis shows that in principle two microphones can be used to capture signals, which contain sufficient information to generate surround sound audio signals. In the following we are explaining how to use spatial audio coding (SAC) to achieve that.

Implementation Details—Using Stereo Microphones with Spatial Audio Coders

In the following, the inventive concept will be described in detail taking reference to FIG. 12, which shows an embodiment of an apparatus for providing both a processed microphone signal and a spatial cue information describing a set of spatial cues associated with an upmix audio signal having more than two channels on the basis of a two-channel input audio signal (typically a two-channel microphone signal).

Figure 12:
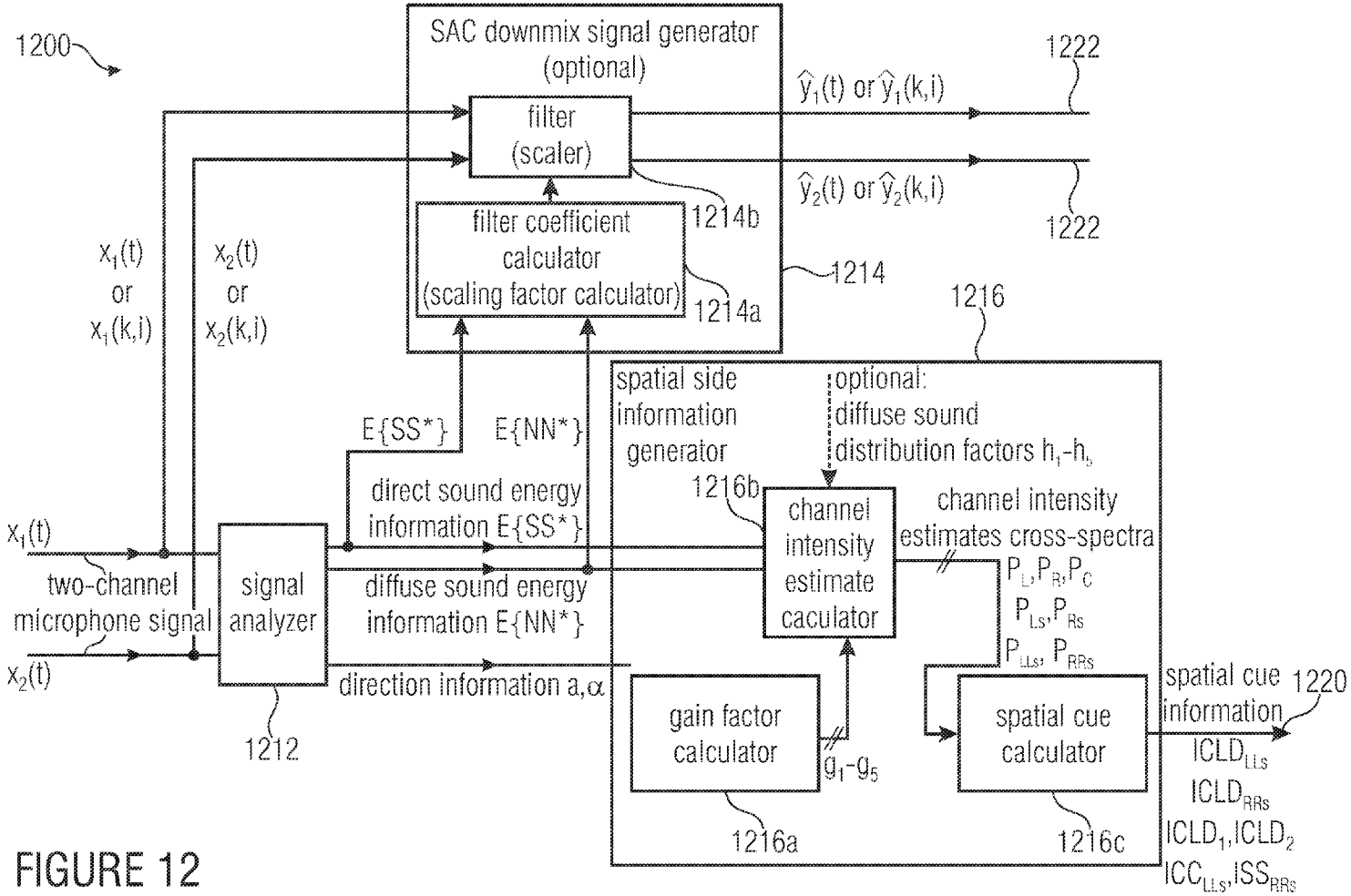
FIG. 12 shows a block schematic diagram of an apparatus for providing a set of spatial cues associated with an upmix audio signal having more than two channels, according to another embodiment of the invention.

The apparatus 1200 of FIG. 12 illustrates the involved functionalities. However, three different configurations will be described on how to use a stereo microphone with a spatial audio coder (SAC) to generate a multi-channel surround signal. The three configurations, which will be explained taking reference to FIGS. 13, 14 and 15 may comprise identical functionalities, wherein the blocks implementing said functionalities are distributed differently to an encoder side and a decoder side.

It should also be noted that in the previous section, two examples of suitable stereo microphone configurations were given (namely the arrangement comprising two cardioid microphones and the arrangement comprising two super-cardioid microphones). However, other microphone arrangements, like the arrangement comprising dipole microphones, may naturally also be used, even though the performance may be somewhat degraded.

Fully SAC Backwards Compatible System

Figure 13:
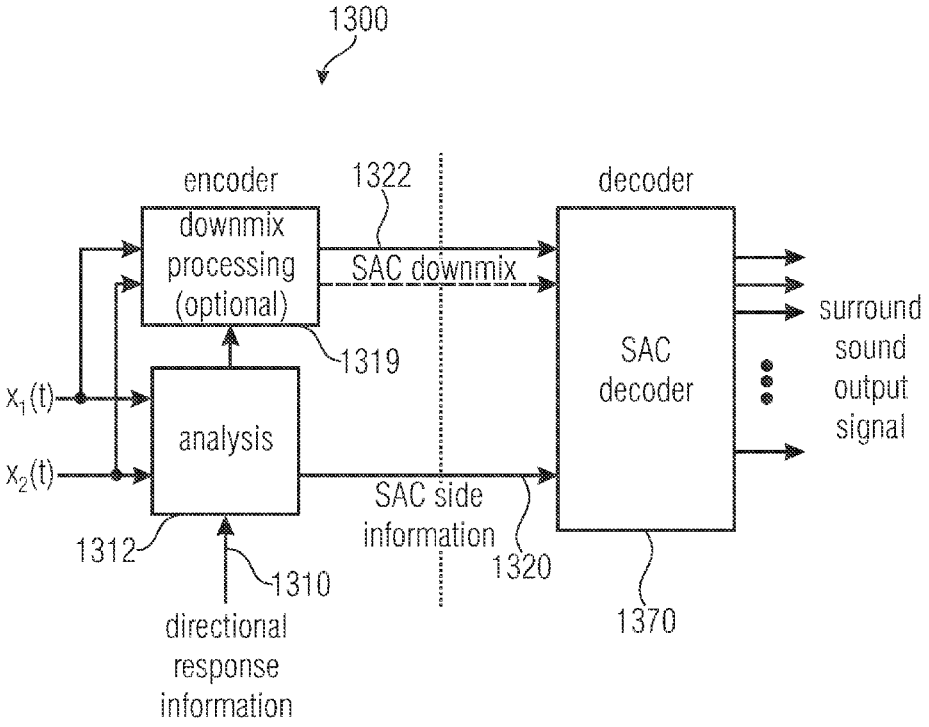
FIG. 13 shows a block schematic diagram of an encoder, which converts the stereo microphone signal to SAC compatible downmix and side information, and also a corresponding (conventional) SAC decoder.

The first possibility is to use an encoder generating a downmix and bitstream compatible with a SAC. FIGS. 12 and 13 illustrate a SAC compatible encoders 1200 and 1300. Given the two microphone signals $x_1(t)$, $x_2(t)$ and the corresponding directional response information 1310, SAC side information 1220, 1320 is generated, which is compatible with the SAC decoder 1370. Additionally, the two microphone signals $x_1(t)$, $x_2(t)$ are processed to generate a downmix signal 1322 compatible with the SAC decoder 1370. Note that there is no need to generate a surround audio signal at the encoder 1200, 1300, resulting in low computational complexity and low memory requirements.

Fully SAC Backwards Compatible System—Microphone Signal Analysis

In the following, a microphone signal analysis will be described, which may be performed by the signal analyzer 1212 or by the analysis unit 1312.

The time-frequency representations (e.g. short-time Fourier transform) of the microphone signals $x_1(n)$ and $x_2(n)$ (or $x_1(t)$ and $x_2(t)$ are $X_1(l,i)$ and $X_2(k,i)$, where k and i are time and frequency indices. It is assumed that $X_1(k,i)$ and $X_2(k,i)$ can be modeled as $$X_1(k,i)=S(k,i)+N_1(k,i)$$

$$X_2(k,i)=a(k,i)S(k,i)+N_2(k,i), \tag{6}$$

where a(k,i) is a gain factor, S(k,i) is direct sound, and $N_1(k,i)$ and $N_2(k,i)$ represents diffuse sound. Note that in the following, for simplicity of notation, we are often ignoring the time and frequency indices k and i. The signal model (6) is similar to the signal model used for stereo signal analysis in (—, "Multi-loudspeaker playback of stereo signals," *J. of the Aud. Eng. Soc.*, vol. 54, no. 11, pp. 1051-1064, November 2006.), except that $N_1$ and $N_2$ are not assumed to be independent.

Used later, the normalized cross-correlation coefficient between the two microphone signals is defined as $$\Phi = \frac{E\{X_1X_2^*\}}{\sqrt{E\{X_1X_1^*\}E\{X_2X_2^*\}}}, \tag{7}$$

where * denotes complex conjugate and E{.} is an averaging operation.

For horizontally diffuse sound, Φ is $$\Phi_{diff} = \frac{\int_{-\pi}^{\pi} r_1(\phi)r_2(\phi)d\phi}{\sqrt{\int_{-\pi}^{\pi} r_1(\phi)^2 d\phi \int_{-\pi}^{\pi} r_2(\phi)^2 d\phi}}, \tag{8}$$

as can easily be verified using similar assumptions as used in (—, "A highly directive 2-capsule based microphone system," in *Preprint* 123*rd Conv. Aud. Eng. Soc.*, October 2007.) for normalized cross-correlation coefficient computation.

The SAC downmix signal and side information are computed as a function of a, $E\{SS^*\}$, $E\{N_1N_1^*\}$, and $E\{N_2N_2^*\}$, where E{.} is a short-time averaging operation. These values are derived in the following.

From (6) it follows that $$E\{X_1X_1^*\}=E\{SS^*\}+E\{N_1N_1^*\}$$

$$E\{X_2X_2^*\}=a^2E\{SS^*\}+E\{N_2N_2^*\}$$

$$E\{X_1X_2^*\}=aE\{SS^*\}+E\{N_1N_2^*\}. \tag{9}$$

It is assumed that the amount of diffuse sound in both microphone signals is the same, i.e. $E\{N_1N_1^*\}=E\{N_2N_2^*\}=E\{NN^*\}$ and that the normalized cross-correlation coefficient between $N_1$ and $N_2$ is $\Phi_{diff}$ (8). Given these assumptions, (9) can be written as $$E\{X_1X^{1*}\}=E\{SS^*\}+E\{NN^*\}$$

$$E\{X_2X_2^*\}=a^2E\{SS^*\}+E\{NN^*\}$$

$$E\{X_1X_2^*\}=aE\{SS^*\}+\Phi_{diff}E\{NN^*\}. \tag{10}$$

Elimination of $E\{SS^*\}$ and a in (9) yields the quadratic equation $$aE\{NN^*\}^2+BE\{NN^*\}+C=0 \tag{11}$$

with $$A=1-\Phi_{diff}^2,$$

$$B=2\Phi_{diff}E\{X_1X_2^*\}-E\{X_1X_1^*\}-E\{X_2X_2^*\},$$

$$C=E\{X_1X_1^*\}E\{X_2X_2^*\}-E\{X_1X_2^*\}^2. \tag{12}$$

Then $E\{NN^*\}$ is one of the two solutions of (11), the physically possible once, i.e.

$$E\{NN^*\} = \frac{-B-\sqrt{B^2-4AC}}{2A}. \tag{13}$$

The other solution of (11) yields a diffuse sound power larger than the microphone signal power, which is physically impossible.

Given (13), it is easy to compute a and $E\{SS^*\}$:

$$a = \sqrt{\frac{E\{X_2X_2^*\}-E\{NN^*\}}{E\{X_1X_1^*\}-E\{NN^*\}}} \tag{14}$$

$$E\{SS^*\} = E\{X_1X_1^*\} - E\{NN^*\}.$$

The direction of direct sound arrival a(k,i) is computed using a(k,i) in (4)

To summarize the above, a direct sound energy information $E\{SS^*\}$, a diffuse sound energy information $E\{NN^*\}$ and a direction information a, $\alpha$ is obtained by the signal analyzer 1212 or the analysis unit 1312. Knowledge of the directional characteristic of the microphones is exploited here. The knowledge of the directional characteristics of the microphones providing the two-channel microphone signal allows the computation of an estimated correlation coefficient $\Phi_{diff}$ (for example, according to equation (8)), which reflects the fact that diffuse sound signals exhibit different cross correlation characteristics than directional sound components. The knowledge of the microphone characteristics may be either applied at a design time of the signal analyzer 1212, 1312 or may be exploited at a run time. In some cases, the signal analyzer 1212, 1312 may be configured to receive an information describing the directional characteristics of the microphones, such that the signal analyzer 1212, 1312 can be dynamically adapted to the microphone characteristics.

To further summarize the above, it can be said that the signal analyzer 1212, 1312 is configured to solve a system of equations describing:

(1) a relationship between an estimated energy (or intensity) of a first channel microphone signal of the two-channel microphone signal, the estimated energy (or intensity) of the direct sound component of the two-channel microphone signal, and the estimated energy of the diffuse sound component of the two-channel microphone signal;

(2) a relationship between an estimated energy (or intensity) of a second channel microphone signal of the two-channel microphone signal, the estimated energy (or intensity) of the direct sound component of the two-channel microphone signal, and the estimated energy of the diffuse sound component of the two-channel microphone signal, and;

(3) a relationship between an estimated cross-correlation value of the first channel microphone signal and the second microphone signal, the estimated energy (or intensity) of the direct sound component of the two-channel microphone signal, and the estimated energy (or intensity) of the diffuse sound component of the two-channel microphone signal;

(see equation (10).

When solving this system of equations, the signal analyzer may take into account the assumption that the energy of the diffuse sound component is equal in the first channel microphone signal and the second channel microphone signal. In addition, it may be taken into account that the ratio of energies of the direct sound component in the first microphone signal and the second microphone signal is direction-dependent. Moreover, it may be taken into account that a normalized cross correlation coefficient between the diffuse sound components in the first microphone signal and the second microphone signal takes a constant value smaller than 1, which constant value is dependent on directional characteristics of the microphones providing the first microphone signal and the second microphone signal. The cross correlation coefficient, which is given in equation (8) may be pre-computed at design time or may be computed at run time on the basis of an information describing the microphone characteristics.

Accordingly, it is possible to firstly compute the autocorrelation of the first microphone signal $x_1$, the autocorrelation of the second microphone signal $x_2$ and the cross correlation between the first microphone signal $x_1$ and the second microphone signal $x_2$, and to derive the component energy information and the direction information from the obtained autocorrelation values and the obtained cross correlation value, for example, using equations (12), (13) and (14).

The microphone signal analysis discussed before may, for example, be performed by the signal analyzer 1212 or by the analysis unit 1312.

Fully SAC Backwards Compatible System—Generation of SAC Downmix Signal

In an embodiment, the inventive apparatus comprises a SAC downmix signal generator 1214, 1314, which is configured to perform a downmix processing in order to provide a SAC downmix signal 1222, 1322 on the basis of the two-channel microphone signal $x_1$, $x_2$. Thus, the SAC downmix signal generator 1214 and the downmix processing 1314 may be configured to process or modify the two-channel microphone signal $x_1$, $x_2$ such that the processed version 1222, 1322 of the two-channel microphone signal $x_1$, $x_2$ comprise the characteristics of a SAC downmix signal and can be applied as an input signal to a conventional SAC decoder. However, it should be noted that the SAC downmix generator 1214 and the downmix processing 1314 should be considered as being optional.

The microphone signals ($x_1$, $x_2$) are sometimes not directly suitable as a downmix signal, since direct sound from the side and rear is attenuated relative to sound arriving from forward directions. The direct sound contained in the microphone signals ($x_1$, $x_2$) needs to be gain compensated by $g(\alpha)$ dB (5), i.e. ideally the SAC downmix should be $$Y_1(k, i) = 10^{\frac{g(\alpha(k,i))}{20}} S(k, i) + 10^{\frac{h}{20}} N_1(k, i) \tag{15}$$

$$Y_2(k, i) = 10^{\frac{g(\alpha(k,i))}{20}} a(k, i) S(k, i) + 10^{\frac{h}{20}} N_2(k, i),$$

where h is a gain in dB controlling the amount of diffuse sound in the downmix. (Here it is assumed that a downmix matrix is used by the SAC with the same weights for front side and rear channels. If smaller weights are used for the rear channels, as optionally recommended by ITU (Rec. ITU-R BS.775, *Multi-Channel Stereophonic Sound System with or without Accompanying Picture*. ITU, 1993, http://www.i-tu.org.), this has to be considered additionally.)

Wiener filters (S. Haykin, Adaptive Filter Theory (third edition). Prentice Hall, 1996.) are used to estimate the desired downmix signal, $$\hat{Y}_1(k,i) = H_1(k,i) X_1(k,i)$$

$$\hat{Y}_2(k,i) = H_2(k,i) X_2(k,i), \tag{16}$$

were the Wiener filters are $$H_1 = \frac{E\{X_1 Y_1^*\}}{E\{X_1 X_1^*\}} \tag{17}$$

$$H_2 = \frac{E\{X_2 Y_2^*\}}{E\{X_2 X_2^*\}}.$$

Note that for brevity of notation the time and frequency indices, k and i, have been omitted again. Substituting (6) and (15) into (17), yields $$H_1 = \frac{10^{\frac{g(\alpha)}{20}} E\{SS^*\} + 10^{\frac{h}{20}} E\{NN^*\}}{E\{SS^*\} + E\{NN^*\}} \tag{18}$$

$$H_2 = \frac{10^{\frac{g(\alpha)}{20}} a^2 E\{SS^*\} + 10^{\frac{h}{20}} E\{NN^*\}}{a^2 E\{SS^*\} + E\{NN^*\}}.$$

The Wiener filter coefficients, for example, as given in equation (18) may be computed, for example, by the filter coefficient calculator (or scaling factor calculator) 1214*a* of the SAC downmix signal generator 1214. Generally speaking, the Wiener filter coefficients can be computed by the downmix processing 1314. Further, the Wiener filter coefficients may be applied to the two-channel microphone signal $x_1$, $x_2$ by the filter (or scaler) 1214*b* to obtain the processed two-channel audio signal or processed to channel microphone signal 1222 comprising a processed first channel signal $\hat{y}_1$ and a processed second microphone signal $\hat{y}_2$. Generally speaking, the Wiener filter coefficients may be applied by the downmix processing 1314 to derive the SAC downmix signal 1322 from the two-channel microphone signal $x_1$, $x_2$.

Fully SAC Backwards Compatible System—Generation of Spatial Side Information

In the following, it will be described how the spatial cue information 1220 is obtained by the spatial side information generator 1216 of the apparatus 1200, and how the SAC side information 1320 is obtained by the analysis unit 1312 of the apparatus 1300. It should be noted that both the spatial side information generator 1216 and the analysis unit 1312 may be configured to provide the same output information, such that the spatial cue information 1220 may be equivalent to the SAC side information 1320.

Given the stereo signal analysis results, i.e. the parameters a respectively $\alpha(4)$, $E\{SS^*\}$, and $E\{NN^*\}$, SAC decoder compatible spatial parameters 1220, 1320 are generated by the spatial side information generator 1216 or the analysis unit 1312. One way of doing this is to consider a multi-channel signal model, e.g.:

$$L(k,i)=g_1(k,i)\sqrt{1+\alpha^2}S(k,i)+h_1(k,i)\tilde{N}_1(k,i)$$

$$R(k,i)=g_2(k,i)\sqrt{1+\alpha^2}S(k,i)+h_2(k,i)\tilde{N}_2(k,i)$$

$$C(k,i)=g_3(k,i)\sqrt{1+\alpha^2}S(k,i)^\circ h_3(k,i)\tilde{N}_3(k,i)$$

$$L_s(k,i)=g_4(k,i)\sqrt{1+\alpha^2}S(k,i)+h_4(k,i)\tilde{N}_4(k,i)$$

$$R_s(k,i)=g_5(k,i)\sqrt{1+\alpha^2}S(k,i)+h_5(k,i)\tilde{N}_5(k,i) \tag{19}$$

where it is assumed that the power of the signals $\tilde{N}_1$ to $\tilde{N}_5$ is equal to $E\{NN^*\}$ and that $\tilde{N}_1$ to $\tilde{N}_5$ are mutually independent. If more than 5 surround audio channels are desired, a model and SAC with more channels are used.

In a first step, as a function of direction of arrival of direct sound $\alpha(k,i)$, a multi-channel amplitude panning law (V. Pulkki, "Virtual sound source positioning using Vector Base Amplitude Panning," *J. Audio Eng. Soc.*, vol. 45, pp. 456-466, June 1997.), (D. Griesinger, "Stereo and surround panning in practice," in *Preprint* 112*th Conv. Aud. Eng. Soc.*, May 2002.) is applied to determine the gain factors $g_1$ to $g_5$. This calculation may be performed by the gain factor calculator 1216*a* of the spatial side information generator 1216. Then, a heuristic procedure is used to determine the diffuse sound gains $h_1$ to $h_5$. The constant values $h_1$=1:0, $h_2$=1:0, $h_3$=0, $h_4$=1:0, and $h_5$=1:0, which may be chosen at design time, are a reasonable choice, i.e. the ambience is equally distributed to front and rear, while the center channel is generated as a dry signal.

Given the surround signal model (19), the spatial cue analysis of the specific SAC used is applied to the signal model to obtain the spatial cues. In the following, we are deriving the cues needed for MPEG Surround, which may be obtained by the spatial side information generator 1216 as an output information 1220 or which may be obtained as the SAC side information 1320 by the analysis unit 1312.

The power spectra of the signals defined in (19) are $$P_L(k,i)=g_1^2(1+\alpha^2)E\{SS^*\}+h_1^2E\{NN^*\}$$

$$P_R(k,i)=g_2^2(1+\alpha^2)E\{SS^*\}+h_2^2E\{NN^*\}$$

$$P_C(k,i)=g_3^2(1+\alpha^2)E\{SS^*\}+h_3^2E\{NN^*\}$$

$$P_{L_s}(k,i)=g_4^2(1+\alpha^2)E\{SS^*\}+h_4^2E\{NN^*\}$$

$$P_{R_s}(k,i)=g_5^2(1+\alpha^2)E\{SS^*\}+h_5^2E\{NN^*\}, \tag{20}$$

These power spectra may be computed by the channel intensity estimate calculator 1216*b* on the basis of the information provided by the signal analyzer 1212 and the gain factor calculator 1216, for example, taking into consideration constant values for $h_1$ to $h_5$. Alternatively, these power spectra may be calculated by the analysis unit 1312.

The cross-spectra, needed in the following are $$P_{LL_s}(k,i)=g_1g_4(1+\alpha^2)E\{SS^*\}$$

$$P_{RR_s}(k,i)=g_2g_5(1+\alpha^2)E\{SS^*\}, \tag{21}$$

The cross-spectra may also be computed by the channel intensity estimate calculator 1216*b*. Alternatively, the cross-spectra may be calculated by the analysis unit 1312.

The first two-to-one (TTO) box of MPEG Surround uses inter-channel level difference (ICLD) and inter-channel coherence (ICC) between L and Ls, which based on (19) are $$ICLD_{LL_s} = 10\log_{10}\frac{P_L(k,i)}{P_{L_s}(k,i)} \tag{22}$$

$$ICC_{LL_s} = \frac{P_{LL_s}(k,i)}{\sqrt{P_L(k,i)P_{L_s}(k,i)}}.$$

Accordingly, the spatial cue calculator 1216 may be configured to compute the spatial cues $ICLD_{LLs}$ and $ICC_{LLs}$ as defined in equation (22) on the basis of the channel intensity estimates and cross-spectra provided by the channel intensity estimate calculator 1216*b*. Alternatively, the analysis unit 1312 may compute the spatial cues as defined in equation (22).

Similarly, the ICLD and ICC of the second TTO box for R and $R_s$ are computed:

$$ICLD_{RR_s} = 10\log_{10}\frac{P_R(k,i)}{P_{R_s}(k,i)} \tag{23}$$

$$ICC_{RR_s} = \frac{P_{RR_s}(k,i)}{\sqrt{P_R(k,i)P_{R_s}(k,i)}}.$$

Accordingly, the spatial cue calculator 1216*c* may be configured to compute the spatial cues $ICLD_{RRs}$ and $ICC_{RRs}$ as defined in equation (23) on the basis of the channel intensity estimates and cross-spectra provided by the channel intensity estimate calculator 1216*b*. Alternatively, the analysis unit 1312 may calculate the spatial cues $ICLD_{RRs}$ and $ICC_{RRs}$ as defined in equation (23).

The three-to-two (TTT) box of MPEG Surround is used in "energy mode". The two ICLD parameters used by the TTT box are $$ICLD_1 = 10\log_{10}\frac{P_L + P_{L_s} + P_R + P_{R_s}}{\frac{1}{2}P_c} \quad (24)$$

$$ICLD_2 = 10\log_{10}\frac{P_L + P_{L_s}}{P_R + P_{R_s}}.$$

Accordingly, the spatial cue calculator 1216*c* may be configured to compute the spatial cues $ICLD_1$ and $ICLD_2$ as defined in equation (24) on the basis of the channel intensity estimates provided by the channel intensity estimate calculator 1216*b*. Alternatively, the analysis unit 1312 may calculate the spatial cues $ICLD_1$, $ICLD_2$ as defined in equation (24).

Note that the indices i and k have been left away again for brevity of notation.

Naturally, it is not mandatory that the spatial cue calculator 1216*c* computes all of the above-mentioned cues $ICLD_{LLs}$, $ICLD_{RRs}$, $ICLD_1$, $ICLD_2$, $ICC_{LLs}$, $ICC_{RRs}$. Rather, it is sufficient if the spatial cue calculator 1216*c* (or the analysis unit 1312) computes a subset of these spatial cues, whichever are needed in the actual application. Similar, it is not necessitated that the channel intensity estimator 1216*b* (or the analysis unit 1312) computes all of the channel intensity estimates $P_L$, $P_R$, $P_C$, $P_{Ls}$, $P_{Rs}$ and cross-spectra $P_{LLs}$, $P_{RRs}$ mentioned above. Rather, it is naturally sufficient if the channel intensity estimate calculator 1216*b* computes those channel intensity estimates and cross-spectra, which are a prerequisite for the subsequent computation of the desired spatial cues by the spatial cue calculator 1216.

System using Microphone Signals as Downmix

The previously described scenario of using an encoder 1200, 1300, generating a SAC compatible downmix 1222, 1322 and spatial side information 1220, 1320, has the advantage that a conventional SAC decoder 1320 can be used to generate the surround audio signal.

Figure 14:
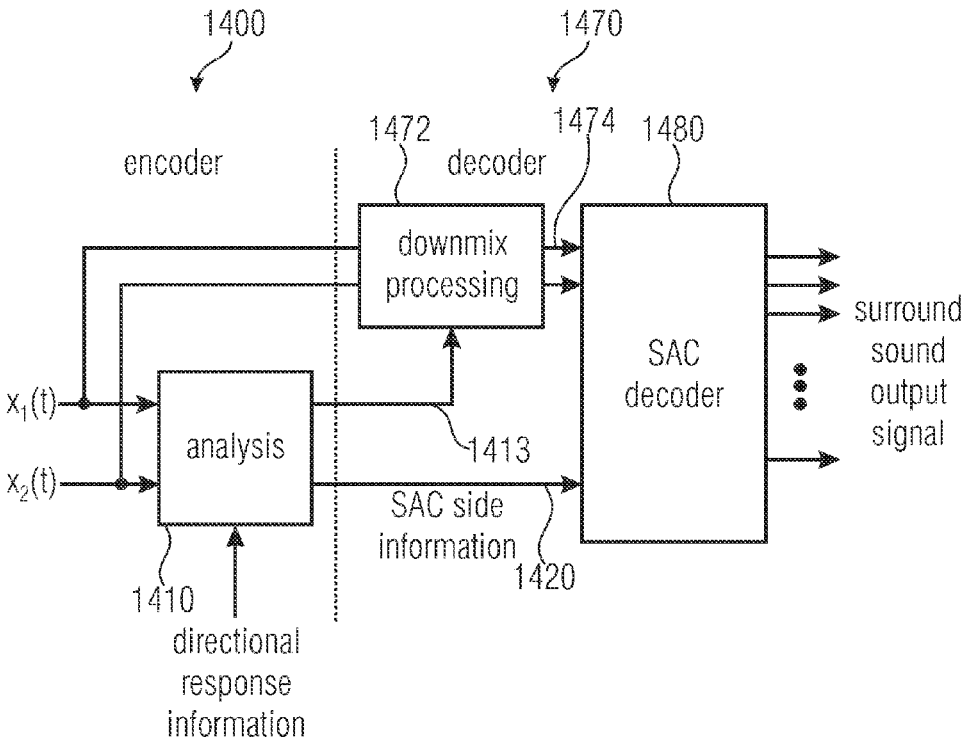
FIG. 14 shows a block schematic diagram of an encoder, which converts the stereo microphone signal to SAC compatible spatial side information and also a block schematic diagram of the corresponding SAC decoder with downmix processing.

If backwards compatibility does not play a role, and if for some reason it is desired to use the unmodified microphone signals $x_1$, $x_2$ as downmix signals, the "downmix processing" can be moved from the encoder 1300 to the decoder 1370, as is illustrated in FIG. 14. Note that in this scenario, the information needed for downmix processing, i.e. (18), has to be transmitted to the decoder in addition to the spatial side information (unless a heuristic algorithm is successfully designed which derives this information from the spatial side information).

In other words, FIG. 14 shows a block schematic diagram of a spatial-audio coding encoder and a spatial-audio coding decoder. The encoder 1400 comprises an analysis unit 1410, which may be identical to the analysis unit 1310, and which may therefore comprise the functionality of the signal analyzer 1212 and of the spatial side information generator 1216. In an embodiment of FIG. 14, a signal transmitted from the encoder 1400 to the extended decoder 1470 comprises the two-channel microphone signal $x_1$, $x_2$ (or an encoded representation thereof). Further, the signal transmitted from the encoder 1400 to the extended decoder 1470 also comprises information 1413, which may, for example, comprise the direct sound energy information E{SS*}, and the diffuse sound energy information E{NN*} (or an encoded version thereof). Furthermore, the information transmitted from the encoder 1400 to the extended decoder 1470 comprises a SAC side information 1420, which may be identical to the spatial cue information 1220 or to the SAC side information 1320. In the embodiment of FIG. 14, the extended decoder 1470 comprises a downmix processing 1472, which may take over the functionality of the SAC downmix signal generator 1214 or of the downmix processor 1314. The extended decoder 1470 may also comprise a conventional SAC decoder 1480, which may be identical in function to the SAC decoder 1370. The SAC decoder 1480 may therefore be configured to receive the SAC side information 1420, which is provided by the analysis unit 1410 of the encoder 1400, and a SAC downmix information 1474, which is provided by the downmix processing 1472 of the decoder on the basis of the two-channel microphone signal $x_1$, $x_2$ provided by the encoder 1400 and the additional information 1413 provided by the encoder 1400. The SAC downmix information 1474 may be equivalent to the SAC downmix information 1322. The SAC decoder 1480 may therefore be configured to provide a surround sound output signal comprising more than two audio channels on the basis of the SAC downmix signal 1474 and the SAC side information 1420.

Blind System

Figure 15:
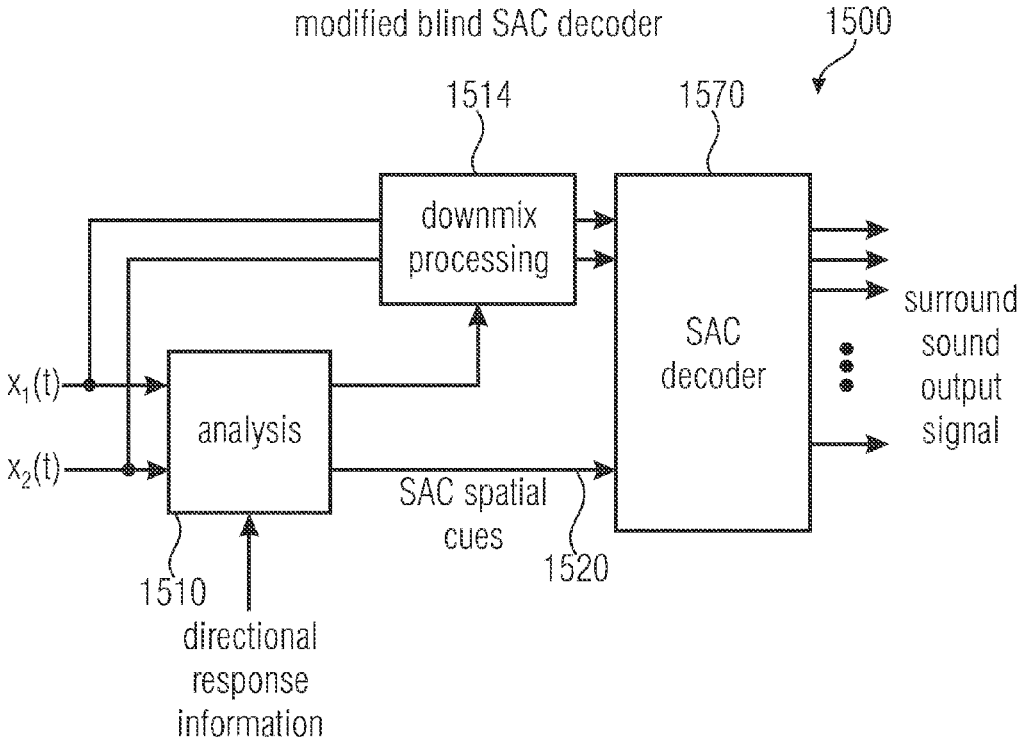
FIG. 15 shows a block schematic diagram of a blind SAC decoder, which can be directly fed with stereo microphone signals, wherein the SAC downmix and the SAC spatial side information are obtained by analysis processing of the stereo microphone signal.

The third scenario that is described, for using SAC with stereo microphones, is a modified "Blind" SAC decoder, that can be fed directly with the microphone signals $x_1$, $x_2$ to generate surround sound signals. This corresponds to moving not only the "Downmix Processing" block 1314 but also the "Analysis" block 1312 from the encoder 1300 to the decoder 1370, as is illustrated in FIG. 15. In contrast to the decoders of the first two proposed systems, the blind SAC decoder needs information on the specific microphone configuration, which is used.

A block schematic diagram of such a modified blind SAC decoder is shown in FIG. 15. As can be seen, the modified blind SAC decoder 1500 is configured to receive the microphone signals $x_1$, $x_2$ and, optionally, a directional response information characterizing the directional response of the microphone arrangement producing the microphone signals $x_1$, $x_2$. As can be seen in FIG. 15, the decoder comprises an analysis unit 1510, which is equivalent to the analysis unit 1310 and to the analysis unit 1410. In addition, the blind SAC decoder 1500 comprises a downmix processing 1514, which is identical to the downmix processing 1314, 1472. In addition, the modified blind SAC decoder 1500 comprises a SAC synthesis 1570, which may be equal to the SAC decoder 1370, 1480. Accordingly, the functionality of the blind SAC decoder 1500 is identical to the functionality of the encoder/decoder system 1300, 1370 and the encoder/decoder system 1400, 1470, with the exception that all of the above described components 1510, 1514, 1540, 1570 are arranged at the decoder side. Therefore, unprocessed microphone signals $x_1$, $x_2$ are received by the blind SAC decoder 1500 rather than processed microphone signals 1322, which are received by the SAC decoder 1370. In addition, the blind SAC decoder 1500 is configured to derive the SAC side information in the form of SAC spatial cues by itself rather than receiving it from an encoder.

Regarding the SAC decoders 1370, 1480, 1570, it should be noted that this unit is responsible for providing a surround sound output signal on the basis of a downmix audio signal and the spatial cues 1320, 1420, 1520. Thus, the SAC decoder 1370, 1480, 1570 comprises an upmixer configured to synthesize the surround sound output signal (which typically comprises more than two audio channels, and comprises 6 or more audio channels (for example 5 surround channels and 1 low frequency channel)) on the basis of the downmix signal (for example, the unprocessed or processed two-channel microphone signal) using the spatial cue information wherein the spatial cue information typically comprises one or more of the following parameters: Inter-channel level difference (ICLD), inter-channel correlation (ICC).

Method

Figure 16:
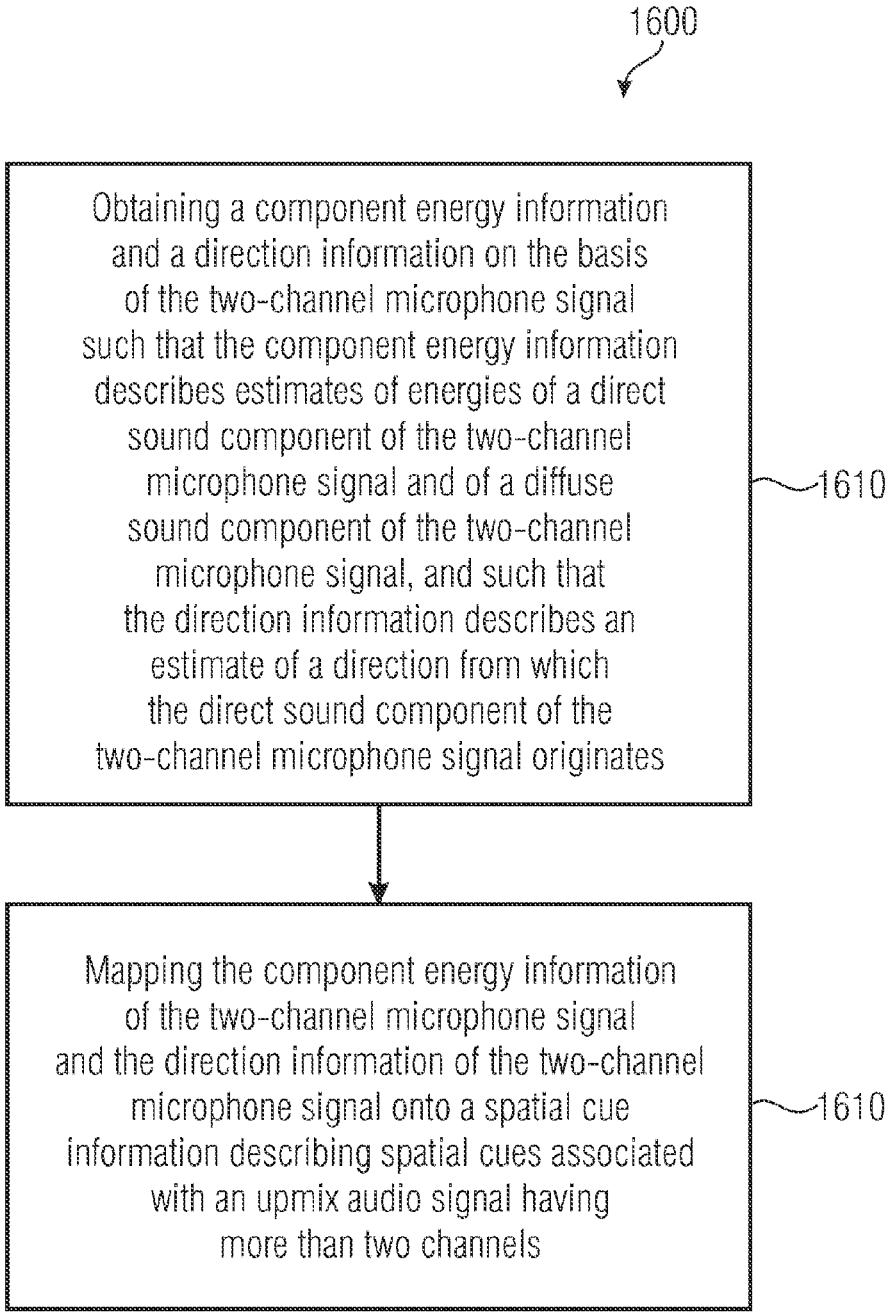
FIG. 16 shows a flow chart of a method for providing a set of spatial cues according to an embodiment of the invention.

FIG. 16 shows a flow chart of a method 1600 for providing a set of spatial cues associated with an upmix audio signal having more than two channels on the basis of a two-channel microphone signal. The method 1600 comprises a first step 1610 of obtaining a component energy information and a direction information on the basis of the two-channel microphone signal, such that the component energy information describes estimates of energies of a direct sound component of the two-channel microphone signal and of a diffuse sound component of the two-channel microphone signal, and such that the direction information describes an estimate of a direction from which the direct sound component of the two-channel microphone signal originates. The method 1600 also comprises a step 1620 of mapping the component energy information of the two-channel microphone signal and the direction information of the two-channel microphone signal onto a spatial cue information describing spatial cues associated with an upmix audio signal having more than two channels. Naturally, the method 1600 can be supplemented by any of the features and functionalities of the inventive apparatus described herein.

Computer Implementation

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal, for example, the SAC downmix signal 1322 in combination with the SAC side information 1320, or the microphone signals $x_1$, $x_2$ in combination with the information 1413, and the SAC side information 1420, or the microphone signals $x_1$, $x_2$, can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

The above-described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

CONCLUSION

Suitability of stereo microphones for surround sound recording by means of using spatial audio coding (SAC) was discussed. Three systems using SAC to generate multi-channel surround audio based on stereo microphone signals were presented. One of these systems, namely the cue system according to FIGS. 12 and 13, is bitstream and decoder compatible with existing SACs, where a dedicated encoder generates the compatible downmix stereo signal and side information directly from the microphone stereo signal. The second proposed system, which has been described with reference to FIG. 14, uses the microphone stereo signal directly as a SAC downmix signal and the third system, which has been described with reference to FIG. 15, is a "blind" SAC decoder converting the stereo microphone signal directly to a multi-channel surround audio signal.

Three different configurations have been described on how to use a stereo microphone with a spatial audio coder (SAC) to generate multi-channel surround audio signals. In the previous section, two examples of particularly suitable stereo microphone configurations were given.

Embodiments according to the invention create a number of two capsule-based microphone front ends for use with conventional SACs to directly capture an encode surround sound. Features of the proposed schemes are:

- The microphone configurations can be conventional stereo microphones or specifically for this purpose optimized stereo microphones.
- Without the need for generating a surround signal at the encoder, SAC compatible downmix and side information are generated.

A high quality stereo downmix signal is generated, used by the SAC decoder to generate the surround sound.

If coding is not desired, a modified "blind" SAC decoder can be used to directly convert the microphone signals to a surround audio signal.

In the present description, the suitability of different stereo microphone configurations for capturing surround sound information has been discussed. Based on these insights, three systems for use of SAC with stereo microphones have been proposed, and some conclusions have been presented.

The suitability of different stereo microphone configurations for capturing surround sound information has been discussed under the section entitled "Stereo Microphones and their Suitability for Surround Recording". Three systems have been described in the section entitled "Using Stereo Microphones with Spatial Audio Coders".

To further summarize, spatial audio coders, such as MPEG Surround, have enabled low bit rate and stereo backwards compatible coding of multi-channel surround audio. Directional audio coding (DirAC) can be viewed as spatial audio coding designed around specific microphone front ends. DirAC is based on B-format spatial sound analysis and has no direct stereo backward compatibility. The present invention creates a number of two capsule-based stereo compatible microphone front-ends and corresponding spatial audio coder modifications, which enable the use of spatial audio coders to directly capture and code surround sound.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for providing a set of spatial cues associated with an upmix audio signal including more than two channels on the basis of a two-channel microphone signal, the apparatus comprising:

a signal analyzer configured to extract a component energy information and a direction information on the basis of the two-channel microphone signal, such that a first parameter of the component energy information describes estimates of energies of a direct sound component of the two-channel microphone signal and a second parameter of the component energy information describes estimates of energies of a diffuse sound component of the two-channel microphone signal, and such that a parameter of the direction information describes an estimate of a direction from which the direct sound component of the two-channel microphone signal originates; and a spatial side information generator configured to map the first and second parameters of the component energy information of the two-channel microphone signal and the parameter of the direction information of the two-channel microphone signal onto a spatial cue parameter information describing the set of spatial cues associated with the upmix audio signal including more than two channels;

wherein the spatial side information generator is configured to map the estimates of the energies of the direct sound component, the estimates of the energies of the diffuse sound component, and the estimate of the direction information onto the spatial cues.

2. The apparatus according to claim 1, wherein the spatial side information generator is configured to directly map the first and second parameters of the component energy information of the two-channel microphone signal and the parameter of the direction information of the two-channel microphone signal onto the spatial cue parameter information describing the set of spatial cues associated with the upmix audio signal including more than two channels.

3. The apparatus according to claim 1, wherein the spatial side information generator is configured to map the first and second parameters of the component energy information of the two-channel microphone signal and the parameter of the direction information of the two-channel microphone signal onto the spatial cue parameter information describing the set of spatial cues associated with the upmix audio signal including more than two channels, without actually using the upmix audio channel as an intermediate quantity.

4. The apparatus according to claim 1, wherein the spatial side information generator is configured to map the parameter of the direction information onto a set of gain factors describing a direction-dependent direct-sound to surround-audio-channel mapping; and wherein the spatial side information generator is also configured to acquire channel intensity estimates describing estimated intensities of more than two surround channels on the basis of the component energy information and the set of gain factors; and wherein the spatial side information generator is configured to determine the spatial cues associated with the upmix audio signal on the basis of the channel intensity estimates.

5. The apparatus according to claim 4, wherein the spatial side information generator is also configured to acquire channel correlation information describing a correlation between different channels of the upmix signal on the basis of the component energy information and the set of gain factors; and wherein the spatial side information generator is also configured to determine spatial cues associated with the upmix signal on the basis of one or more of the channel intensity estimates, and the channel correlation information.

6. The apparatus according to claim 4, wherein the spatial side information generator is configured to linearly combine an estimate of an intensity of the direct sound component of the two-channel microphone signal and an estimate of an intensity of the diffuse sound component of the two-channel microphone signal in order to acquire the channel intensity estimates; and wherein the spatial side information generator is configured to weight the estimate of the intensity of the direct sound component based on the gain factors and on the direction information.

7. The apparatus according to claim 4, wherein the spatial side information generator is configured to acquire an estimated power spectrum value $P_L$ of a left front surround channel of the upmix audio signal according to $$P_L=g_1^2(f(a)E\{SS^*\}+h_1^2E\{NN^*\}$$

to acquire an estimated power spectrum value $P_R$ of a right front surround channel of the upmix audio signal according to $$P_R=g_2^2(f(a)E\{SS^*\}+h_2^2E\{NN^*\}$$

to acquire an estimated power spectrum value $P_C$ of a center surround channel of the upmix audio signal according to $$P_C=g_3^2(f(a)E\{SS^*\}+h_3^2E\{NN^*\}$$

to acquire an estimated power spectrum value $P_{Ls}$ of a left rear surround channel of the upmix audio signal according to $$P_{Ls}=g_4^2(f(a)E\{SS^*\}+h_4^2E\{NN^*\}$$

and to acquire an estimated power spectrum value $P_{Rs}$ of a right rear surround channel according to $$P_{Rs}=g_5^2(f(a)E\{SS^*\}+h_5^2E\{NN^*\}$$

wherein the spectral side information generator is also configured to compute a plurality of different inter-channel level differences using the estimated power spectrum values;

wherein $g_1$, $g_2$, $g_3$, $g_4$, $g_5$ are gain factors describing a direction-dependent direct-sound to surround-audio-channel mapping;

wherein f(a) is a direction-dependent amplitude correction factor;

wherein E{SS*} is a component energy information describing an estimate of an energy of a direct sound component of the two-channel microphone signal;

wherein E{NN*} is a component energy information describing an estimate of an energy of a diffuse sound component of the two-channel microphone signal; and wherein $h_1$, $h_2$, $h_3$, $h_4$, $h_5$ are diffuse sound distribution factors describing a diffuse-sound to surround-audio-channel mapping.

8. The apparatus according to claim 4, wherein the spatial side information generator is configured to acquire an estimated cross correlation spectrum value $P_{LLs}$ between a left front surround channel and a left rear surround channel of the upmix audio signal according to $$P_{LLs}=g_1g_4(f(a)E\{SS^*\}$$

to acquire an estimated cross correlation spectrum value $P_{RRs}$ between a right front surround channel and a right rear surround channel according to $$P_{RR_s}=g_2g_5(f(a)E\{SS^*\}, \quad (21)$$

and to combine the estimated cross correlation spectrum values $P_{LLs}$ and $P_{RRs}$ with the estimated power spectrum values $P_L$, $P_R$, $P_C$, $P_{Ls}$, and $P_{Rs}$ of the upmix audio signal to acquire inter-channel coherence cues;

wherein $g_1$, $g_2$, $g_4$, $g_5$ are gain factors describing a direction-dependent direct-sound power surround-audio-channel mapping;

wherein f(a) is a direction-dependent amplitude correction factor;

wherein E{SS*} is a component energy information describing an estimate of an energy of a direct sound component of the two-channel microphone signal; and wherein E{NN*} is a component energy information describing an estimate of an energy of a diffuse sound component of the two-channel microphone signal.

9. The apparatus according to claim 1, wherein the signal analyzer is configured to solve a system of equations describing (1) a relationship between an estimated energy of a first channel microphone signal of the two-channel microphone signal, the estimated energy of the direct sound component of the two-channel microphone signal, and the estimated energy of the diffuse sound component of the two-channel microphone signal, (2) a relationship between an estimated energy of a second channel microphone signal of the two-channel microphone signal, the estimated energy of the direct sound component of the two-channel microphone signal, and the estimated energy of the diffuse sound component of the two-channel microphone signal, and (3) a relationship between an estimated cross correlation value of the first channel microphone signal and the second channel microphone signal, the estimated energy of the direct sound component of the two-channel microphone signal, and the estimated energy of the diffuse sound component of the two-channel microphone signal, taking into account the assumptions that the energy of the diffuse sound component is identical in the first channel microphone signal and the second channel microphone signal, that a ratio of energies of the direct sound component in the first microphone signal and the second microphone signal is direction-dependent, and that a normalized cross-correlation coefficient between the diffuse sound components in the first microphone signal and the second microphone signal has a constant value smaller than one, which constant value is dependent on directional characteristics of microphones providing the first microphone signal and the second microphone signal.

10. An apparatus for providing a two-channel audio signal and a set of spatial cues associated with an upmix audio signal including more than two channels, the apparatus comprising:

a microphone arrangement including a first directional microphone and a second directional microphone;

wherein the first directional microphone and the second directional microphone are spaced no more than about 30 cm apart, and the first directional microphone and the second directional microphone are oriented such that a directional characteristic of the second directional microphone is a rotated version of a directional characteristic of the first directional microphone; and an apparatus for providing a set of spatial cues associated with the upmix audio signal including more than two channels on the basis of a two-channel microphone signal, the apparatus comprising:

a signal analyzer configured to extract a component energy information and a direction information on the basis of the two-channel microphone signal, such that a first parameter of the component energy information describes estimates of energies of a direct sound component of the two-channel microphone signal and a second parameter of the component energy information describes estimates of energies of a diffuse sound component of the two-channel microphone signal, and such that a parameter of the direction information describes an estimate of a direction from which the direct sound component of the two-channel microphone signal originates; and a spatial side information generator configured to map the first and second parameters of the component energy information of the two-channel microphone signal and the parameter of the direction information of the two-channel microphone signal onto a spatial cue parameter information describing the set of spatial cues associated with the upmix audio signal including more than two channels;

wherein the spatial side information generator is configured to map the estimates of the energies of the direct sound component, the estimates of the energies of the diffuse sound component, and the estimate of the direction information onto the spatial cues;

wherein the apparatus for providing a set of spatial cues associated with the upmix audio signal is configured to receive the microphone signals of the first and second directional microphones as the two-channel microphone signal, and to provide the set of spatial cues on the basis thereof; and a two-channel audio signal provider configured to provide the microphone signals of the first and second directional microphones, or processed versions thereof, as the two-channel audio signal.

11. An apparatus for providing a processed two-channel audio signal and a set of spatial cues associated with an upmix signal including more than two channels on the basis of a two-channel microphone signal, the apparatus comprising:

an apparatus for providing a set of spatial cues associated with the upmix audio signal including more than two channels on the basis of the two-channel microphone signals, the apparatus comprising:

a signal analyzer configured to extract a component energy information and a direction information on the basis of the two-channel microphone signal, such that a first parameter of the component energy information describes estimates of energies of a direct sound component of the two-channel microphone signal and a second parameter of the component energy information describes estimates of energies of a diffuse sound component of the two-channel microphone signal, and such that a parameter of the direction information describes an estimate of a direction from which the direct sound component of the two-channel microphone signal originates; and a spatial side information generator configured to map the first and second parameters of the component energy information of the two-channel microphone signal and the parameter of the direction information of the two-channel microphone signal onto a spatial cue parameter information describing the set of spatial cues associated with the upmix audio signal including more than two channels;

wherein the spatial side information generator is configured to map the estimates of the energies of the direct sound component, the estimates of the energies of the diffuse sound component, and the estimate of the direction information onto the spatial cues; and a two-channel audio signal provider configured to provide processed two-channel audio signal on the basis of the two-channel microphone signal;

wherein the two-channel audio signal provider is configured to scale a first audio signal of the two-channel microphone signal using at least one first microphone signal scaling factor, to acquire a first processed audio signal of the processed two-channel audio signal;

wherein the two-channel audio signal provider is also configured to scale a second audio signal of the two-channel microphone signal using at least one second microphone signal scaling factor, to acquire a second processed audio signal of the processed two-channel audio signal;

wherein the two-channel audio signal provider is configured to compute the at least one first microphone signal scaling factor and the at least one second microphone signal scaling factor on the basis of the component energy information provided by the signal analyzer of the apparatus for providing a set of spatial cues, such that both the spatial cues and the at least one first microphone signal scaling factor and the at least one second microphone signal scaling factor are determined by the component energy information.

12. A method for providing a set of spatial cues associated with an upmix audio signal including more than two channels on the basis of a two-channel microphone signal, the method comprising:

extracting a component energy information and a direction information on the basis of the two-channel microphone signal, such that a first parameter of the component energy information describes estimates of energies of a direct sound component of the two-channel microphone signal and a second parameter of the component energy information describes estimates of energies of a diffuse sound component of the two-channel microphone signal, and such that a parameter of the direction information describes an estimate of a direction from which the direct sound component of the two-channel microphone signal originates; and mapping the parameters of the component energy information of the two-channel microphone signal and the parameter of the direction information of the two-channel microphone signal onto a spatial cue parameter information describing spatial cues associated with the upmix audio signal including more than two channels;

wherein the estimates of energies of the direct sound component, the estimates of the energies of the diffuse sound component, and the estimate of the direction information are mapped onto the spatial cues.

13. A non-transitory digital storage medium comprising a computer program for performing, when the computer program is run on a computer, a method for providing a set of spatial cues associated with an upmix audio signal including more than two channels on the basis of a two-channel microphone signal, the method comprising:

extracting a component energy information and a direction information on the basis of the two-channel microphone signal, such that a first parameter of the component energy information describes estimates of energies of a direct sound component of the two-channel microphone signal and a second parameter of the component energy information describes estimates of energies of a diffuse sound component of the two-channel microphone signal, and such that a parameter of the direction information describes an estimate of a direction from which the direct sound component of the two-channel microphone signal originates; and mapping the parameters of the component energy information of the two-channel microphone signal and the parameter of the direction information of the two-channel microphone signal onto a spatial cue parameter information describing spatial cues associated with the upmix audio signal including more than two channels;

wherein the estimates of energies of the direct sound component, the estimates of the energies of the diffuse sound component, and the estimate of the direction information are mapped onto the spatial cues.

* * * * *